US010055928B1

(12) United States Patent
Van Horn

(10) Patent No.: US 10,055,928 B1
(45) Date of Patent: Aug. 21, 2018

(54) HIGHLY ADJUSTABLE PUSH-TYPE DISPENSING MODULE FOR DISPENSING ITEMS

(71) Applicant: Fawn Engineering Corporation, Clive, IA (US)

(72) Inventor: John Van Horn, Clive, IA (US)

(73) Assignee: Fawn Engineering Corporation, Clive, IA (US)

( * ) Notice: Subject to any disclaimer, the term of this patent is extended or adjusted under 35 U.S.C. 154(b) by 150 days.

(21) Appl. No.: 15/096,042

(22) Filed: Apr. 11, 2016

(51) Int. Cl.
*G07F 11/00* (2006.01)
*G07F 11/42* (2006.01)

(52) U.S. Cl.
CPC ..... *G07F 11/42* (2013.01)

(58) Field of Classification Search
CPC ..... G07F 11/42
USPC ..... 700/232
See application file for complete search history.

(56) References Cited

U.S. PATENT DOCUMENTS 3,831,807 A * 8/1974 Deaton ..... G07F 11/58 221/85
4,043,483 A * 8/1977 Gore ..... G07F 11/38 221/155
6,253,954 B1 * 7/2001 Yasaka ..... G07F 11/42 221/131
7,222,748 B2 * 5/2007 Holdway ..... G07F 11/16 221/133
7,565,222 B2 7/2009 Popelka
7,819,281 B2 10/2010 Guindulain Busto
9,171,300 B2 10/2015 Westby et al.
9,357,856 B2 * 6/2016 Szpak ..... A47F 1/04
D801,734 S * 11/2017 Turner ..... D6/681.1
(Continued)

FOREIGN PATENT DOCUMENTS

EP 1970867 B1 11/2010

OTHER PUBLICATIONS

NAMA, "Micro Market—A New Innovation in Automatic Merchandising", Technical Bulletin Micro Markets 4-13, v. 4.0, 4 pages, Mar. 2013.

*Primary Examiner* — Anna M Momper
*Assistant Examiner* — Stephen L Akridge
(74) *Attorney, Agent, or Firm* — McKee, Voorhees & Sease, PLC

(57) ABSTRACT

An apparatus, method, and system of dispensing a row of inventory by advancing the row forward. An elongated member has opposite ends, either of which can receive and mount an actuator, e.g. electric motor. A drive member, e.g. a lead screw, extends along the elongated member and is connectable to the actuator. A push member, e.g. plate, linearly moves along the elongated body in response to the drive member. The assembly is highly adjustable. In one aspect, it is self-contained and can be mounted and adjusted in different positions on a support such as a tray, shelf, or frame. In another aspect, it can be selectively configured between different states. One state has the elongated member mounted in the support in one way, with the actuator at the back and the push member extending laterally in a first direction. In another state, the push member extends laterally an opposite direction. An optional gate can be added to the end of the elongated member opposite the actuator and can open and close automatically upon each vend or dispensing of an item from the row.

25 Claims, 22 Drawing Sheets

(56) References Cited

U.S. PATENT DOCUMENTS

| | | | | |
|---|---|---|---|---|
| 2001/0000610 | A1* | 5/2001 | Johnson | G07F 11/42 221/13 |
| 2003/0000956 | A1* | 1/2003 | Maldonado | A47F 1/125 221/120 |
| 2005/0000977 | A1* | 1/2005 | Mazlout | G07F 11/42 221/231 |
| 2008/0223870 | A1* | 9/2008 | Guindulain Busto | G07F 11/42 221/120 |
| 2010/0237091 | A1* | 9/2010 | Garson | G07F 9/026 221/226 |
| 2010/0280655 | A1* | 11/2010 | Wilson | G07F 11/42 700/231 |
| 2011/0173549 | A1 | 7/2011 | Hipskind | |
| 2012/0104018 | A1 | 5/2012 | Maule | |
| 2012/0247246 | A1* | 10/2012 | Gemberling, Jr. | G07F 11/42 74/412 R |
| 2013/0332271 | A1 | 12/2013 | Hay | |
| 2014/0061225 | A1* | 3/2014 | Chen | G07F 11/24 221/277 |

* cited by examiner

HIGHLY ADJUSTABLE PUSH-TYPE DISPENSING MODULE FOR DISPENSING ITEMS

I. BACKGROUND OF THE INVENTION

A. Field of the Invention

The present invention relates to automated merchandising/dispensing/vending and, in particular, to a push plate type dispensing module that can be removably and adjustably mounted to a horizontal dispensing tray, or other support, either singly or in combinations. the Dispensing Module is of the Type that Dispenses a Row of Inventory by Advancing the row forward.

B. Problems in the Art

There continues to be an explosion of new vending or dispensing regimes and contexts. For example, the traditional standalone automated can/bottle or snack vending machine can now vend such things as gift cards, cell phones, and other non-food or beverage items for consumer purchase. This has been further extended to dispensing of supplies to workers. Examples are drill or machine bits for machinists, surgical gloves to surgeons, and pharmaceuticals to nurses.

Another example is called micro markets. Instead of a single enclosed, standalone dispensing machine cabinet, inventory can be stocked on shelves, display cases, or other storage units, picked and removed by a consumer or user, and then brought by the consumer or user to a coin/bill/card reader or validator for payment or authorization which is separated from the stored position of the selected item. The validator or reader not only can accept payment or credit, it can do such things as keep track of sales/inventory or communicate to and from another device.

The National Automatic Merchandizing Association (NAMA) has defined "micro markets" as:

> "A micro market is a self-checkout retail food establishment that replaces a bank of vending machines. In a micro market a customer picks up a product from an open rack display, a reach-in refrigerated cooler or freezer, then scans the UPC bar code or an RFID tag for each product at a payment kiosk. The customer pays with a single payment, be it cash, credit card or stored value card. Another unique feature of the micro market is that it operates without an employee present, just like vending machines. All micro markets are equipped with a 24 hour a day security system monitoring customers as they make their selections and checkout. Micro markets are designed to be in "closed locations." This refers to a business that has a moderately secured facility for a known group of employees where the micro market can be located in a designated area away from heavy public traffic."

See NAMA Technical Bulletin Micro Markets 4-13 v.4.0 available at http://www.vending.org/images/pdfs/micromarket/Tech_W7_bulletin_Micro_Market_v4.0.pdf. Certain States and federal government agencies have enacted laws or regulations about these types of micro markets.

The variety of product types, form factors, weights, temperature demands, and other characteristics or needs is immense in micro markets. The designer of such systems is faced with a number of considerations. Sometimes they are conflicting. Additional discussion of micro markets and dispensing can be found at U.S. 2015/0127478 (now issued U.S. Pat. No. 9,171,300); US2013/0332271, and US2011/0173549, each of which is incorporated by reference herein.

Some of these same issues also exist with more conventional automatic merchandising machines. As mentioned, innovations and demands relative to a wider range of items and environments to be dispensed from these machines presents challenges to the designer of an enclosed, self-contained automatic merchandising machine.

For example, the number of different dispensable products can be quite high. This implicates a wide variety of form factors, which implicates the need for different automated dispenser mechanisms. This conflicts with goals of economy and efficiency of both capital expenses and human resources for setting up and changing out different dispensers. Another example is economy and efficiency of control of multiple dispensers. On the one hand, different dispensers (e.g. different motors, different product holding structure, and different product conveying methods) are implicated for a variety of difference dispensable products, but this would complicate coordinated and automated control of those dispensing sub-systems.

Therefore, a variety of marketplace forces and factors have evolved that continue to challenge and change the industry. Some carry over from before. For example, it remains beneficial to innovate ways to reduce capital and operating costs. It remains beneficial to maximize space for inventory, wherever it is stored. It remains beneficial to reduce human resources in restocking. However, additional or new factors include such things as demands for vending or dispensing products that heretofore might not be envisioned or deemed possible. Additional factors have expanded demands for flexibility and the types, locations, and interaction between inventory and consumer, and with other machines, locations, and interested parties.

Therefore, there remains room for improvement in this technical field, both with respect to conventional automatic merchandising machines and micro markets.

II. SUMMARY OF THE INVENTION

A. Objects of the Invention

A principal object, feature, aspect, or advantage of the present invention is a dispensing apparatus, method, or system which improves over or solves problems and deficiencies in the art.

Other objects, features, aspects, or advantages relate to an apparatus, method, or system as above described which:

a. is adaptable to a wide variety of machines and dispensing situations;
b. is adaptable to a wide variety of vendible or dispensable products, including different types, sizes, weight, and form factors;
c. provides for quick inventory loading and restocking;
d. has flexibility to change its configuration without additional parts;
e. can increase inventory capacity at least over spiral-based dispensers;
f. is relatively economical; or
g. can assist in efficient placement and control of multiple dispensers on the same horizontal tray or level, as well as on multiple levels.

These and other objects, features, aspects, or advantages will become more apparent with reference to the accompanying specification and claims.

B. Aspects of the Invention

In one aspect of the invention, a dispensing module comprises an elongated member that supports a drive member between front and back ends. One example of a drive member is a lead screw. A push member (sometimes alternatively called a transition member) extends laterally from the elongated member and is operatively connected to the drive member to move fore and aft depending on the driving direction of the drive member by an actuator at the back end. One example of an actuator is an electric motor. In this manner, inventory can be placed in a row ahead of the push plate. By motor control, a push plate can push the row forward for individual dispensing of inventory. This allows essentially unobstructed space in that row and accepts a wide variety of dispensable objects. The self-contained module allows for adjustable placement along a horizontal support, such as a tray, shelf, or frame.

In another aspect of the invention, a push member type dispensing module includes a quick mount subsystem. In one embodiment, the front end has a hook or flange that can prevent longitudinal movement of the module when in a hooked position on a support (e.g. a cabinet shelf or tray, an open rack display, a wall mounted shelf, etc.). The back end can have a releasable clamp. When the front hook is positioned at the front of a tray or other structural feature of the dispensing machine or display rack and the clamp is locked at the back, the module is fixed in position against movement in any direction. A simple lever release of the clamp allows quick lateral positioning or removal. The hook or flange and the clamp can be placed at either front or back ends of the elongated member. Therefore, the module can be mounted in reversed positions with the clamp always at the back end.

In another aspect of the invention, the push member of the module can be expandable laterally. Thus, without replacement or changeover, the module can be adjusted to push inventory of different widths.

In another aspect of the invention, a front gate or retainer can be associated with the elongated member and automatically pivot open to release the first-in-line item of inventory when the row is pushed forward by the push member. In one embodiment, the gate has a linkage to the drive member. The gate is normally biased to a blocking or closed position. This serves as protection against items from the row unintentionally spilling out of the dispenser, such as when the vending machine is shaken or the tray is being restocked. When the drive member is operated in either direction, a linkage between the gate and the drive member opens the gate until the state where the front-most item in the row is dispensed, as the drive member also operates the push member to push the row forward to the point the front-most item moves past the front edge of the tray and falls by gravity to dispensing bin or location. A control regime operates the drive member to push the row forward to dispense one item from the row at a time. Once the drive member stops forward operation based on the assumption one product has been dispenses, the control regime reserves the drive member operation for a short time to pull the gate back to blocking or closed position in combination with the gate tensioned to the closed position by the biasing member.

In another aspect of the invention, the dispensing module can be easily converted between the push member being on one side or the other. An interface between the push member and the drive member is releasable and reversible in the sense the interface can be re-engaged with the drive member with the push member extending laterally from the opposite side of the module. If a front gate or retainer is used, it too can be quickly converted to extend laterally it either direction from the front of the module. In one aspect, these conversions can be done manually or with only a few reconfiguration, and without needed substituted or additional parts.

In another aspect of the invention, a pair of dispensing modules can be positioned and operated in a coordinated manner. In one embodiment, a first module can be configured with actuator in the back and installed with push member extending laterally in one direction relative the support on which the module is mounted. A second module can configured with motor in the back, but the elongated member reversed so that its push plate extends in an opposite lateral direction from that of the first module. By mounting the pair of modules spaced apart but with push members extending towards one another, and coordinated operation of actuators of both modules, the pair of push plates can move and work together, such as in dispensing objects that are much wider than the push plate of a single module, even if extendable. Quick release actuators allows essentially configuration of mirror-image modules that can work in tandem to dispense one row of items. If front gates are added, they could also work in tandem, again essentially in mirror image, to open and release foremost objects in the row of inventory, and then close and block a succeeding item in the row.

III. BRIEF DESCRIPTION OF THE DRAWINGS

Figure 3:
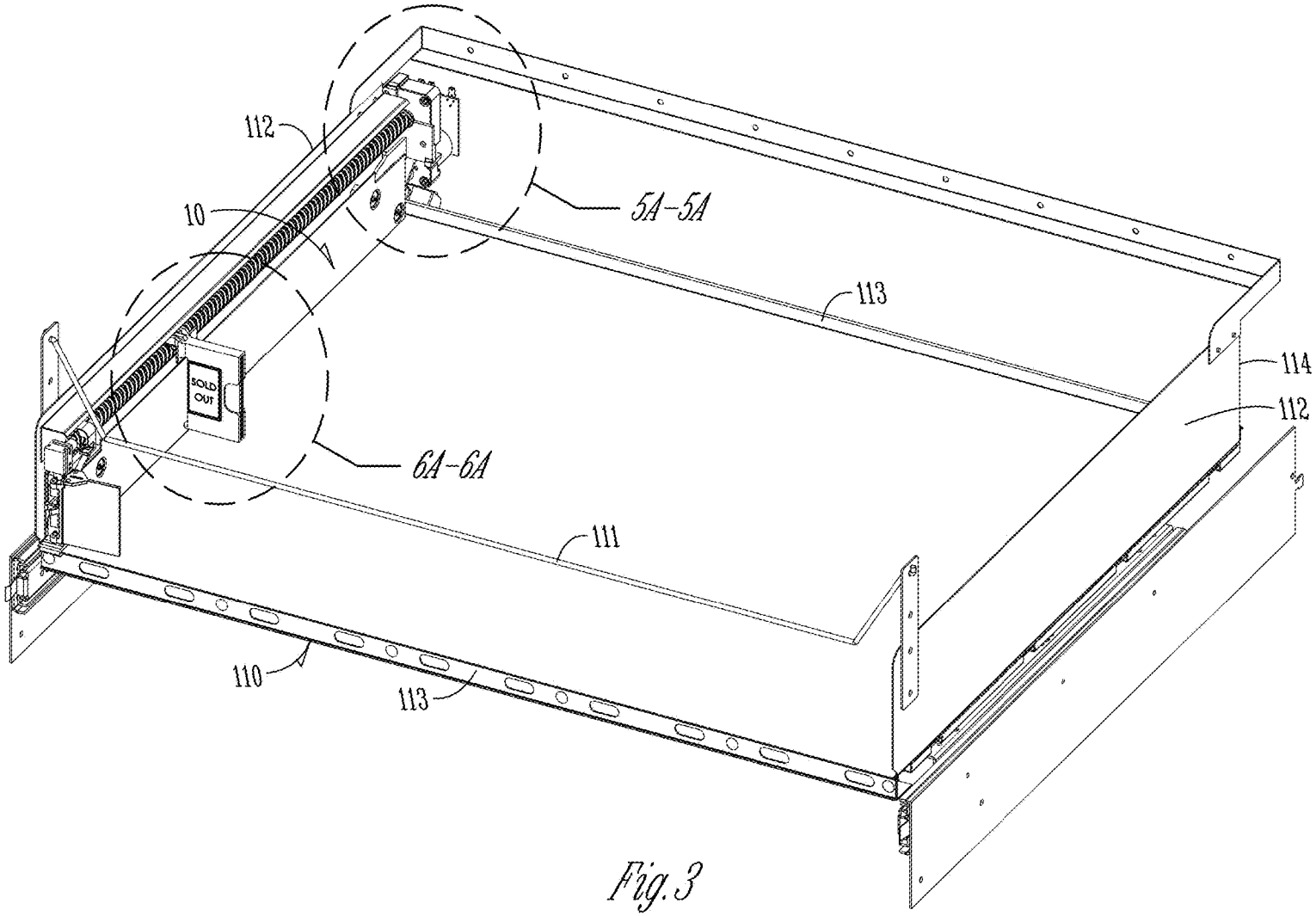
FIG. 3 is a perspective view of just one module of FIGS. 1A and 1B installed on a horizontal dispenser tray.
Figure 5A:
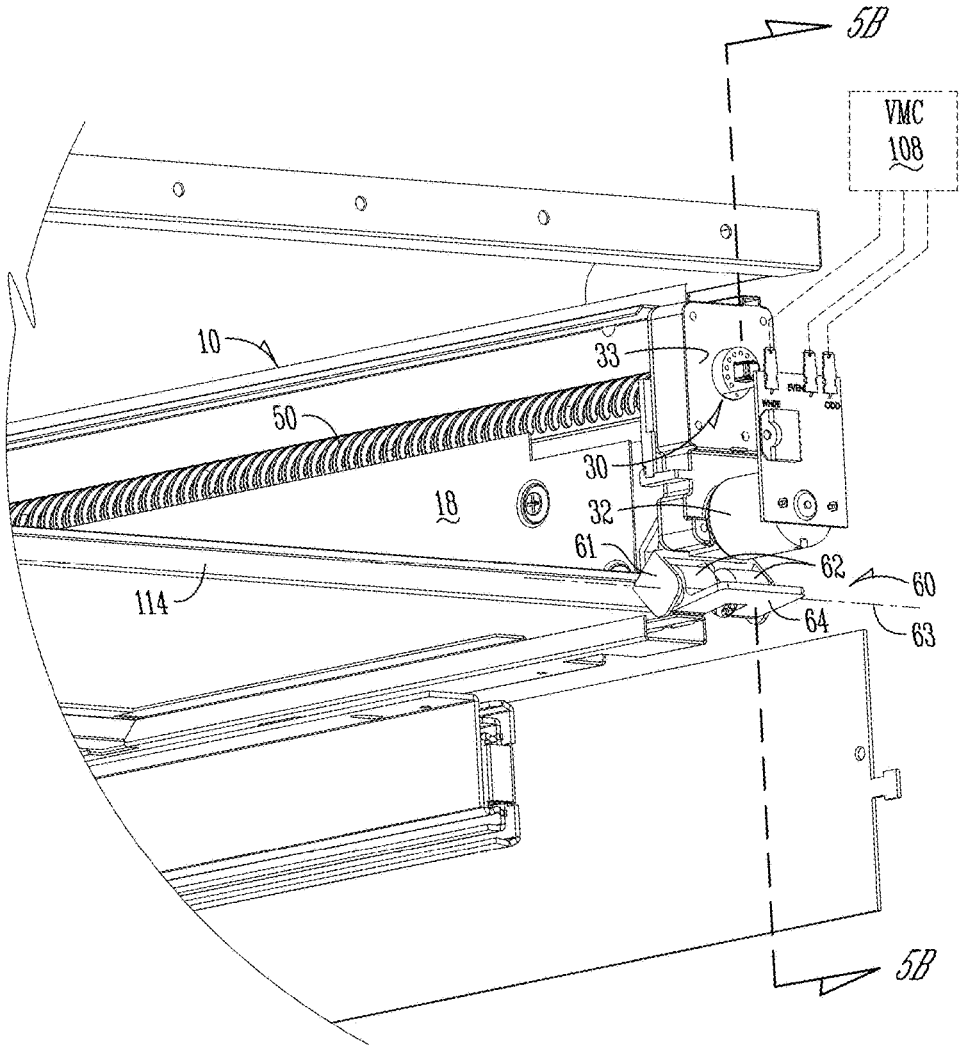

FIG. 5A is an enlarged perspective at line 5A-5A of FIG. 3, showing the back end of the module clamped to back edge of a tray. It includes in dashed lines a schematic of how the motor unit would be connected to a vending machine controller or other intelligent controller. Further it illustrates mounting of the back end of the module to the back end of a horizontal dispensing tray.

Figure 5B:
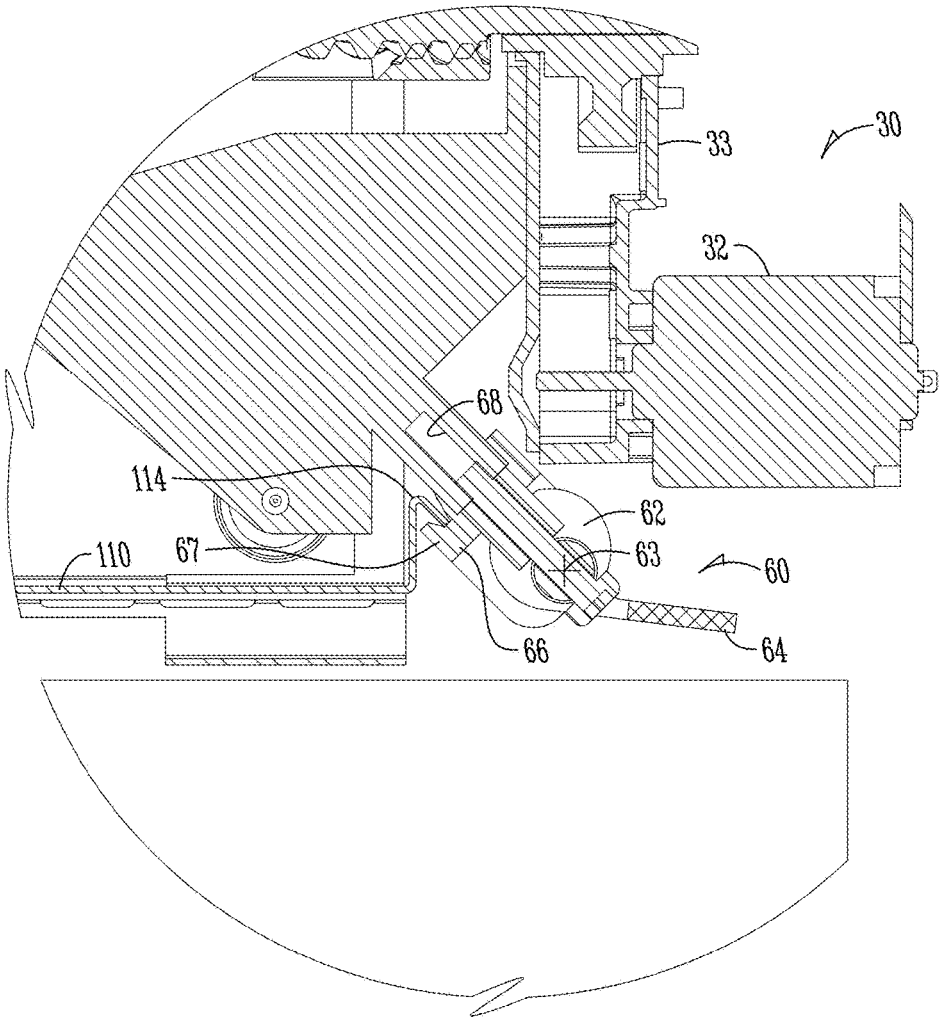

FIG. 5B is a further enlarged sectional view of the back end taken along line 5B-5B of FIG. 5A.

Figure 5C:
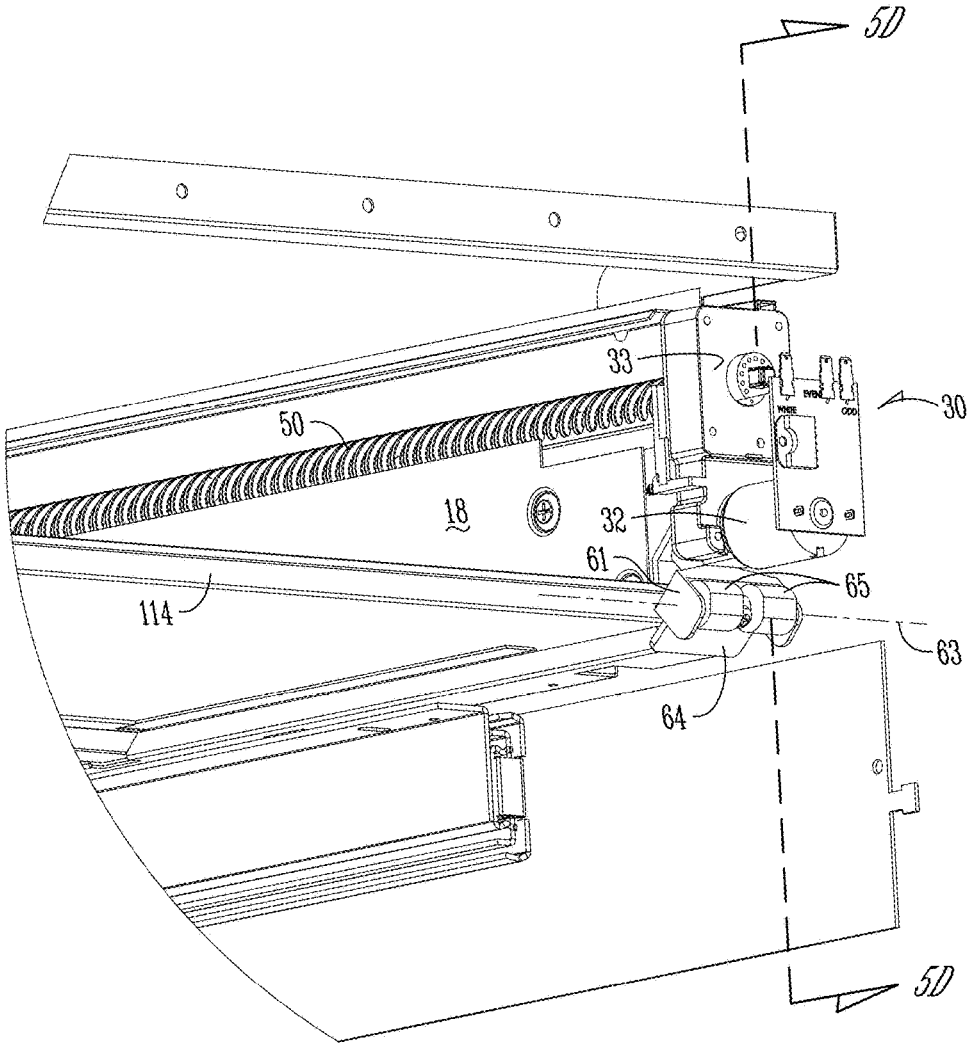

FIG. 5C is similar to FIG. 5A except showing an enlarged perspective view of a clamp member with eccentric cam in an unlocked position at the back of the module for clamping the back of the module to the back of a dispensing tray.

Figure 5D:
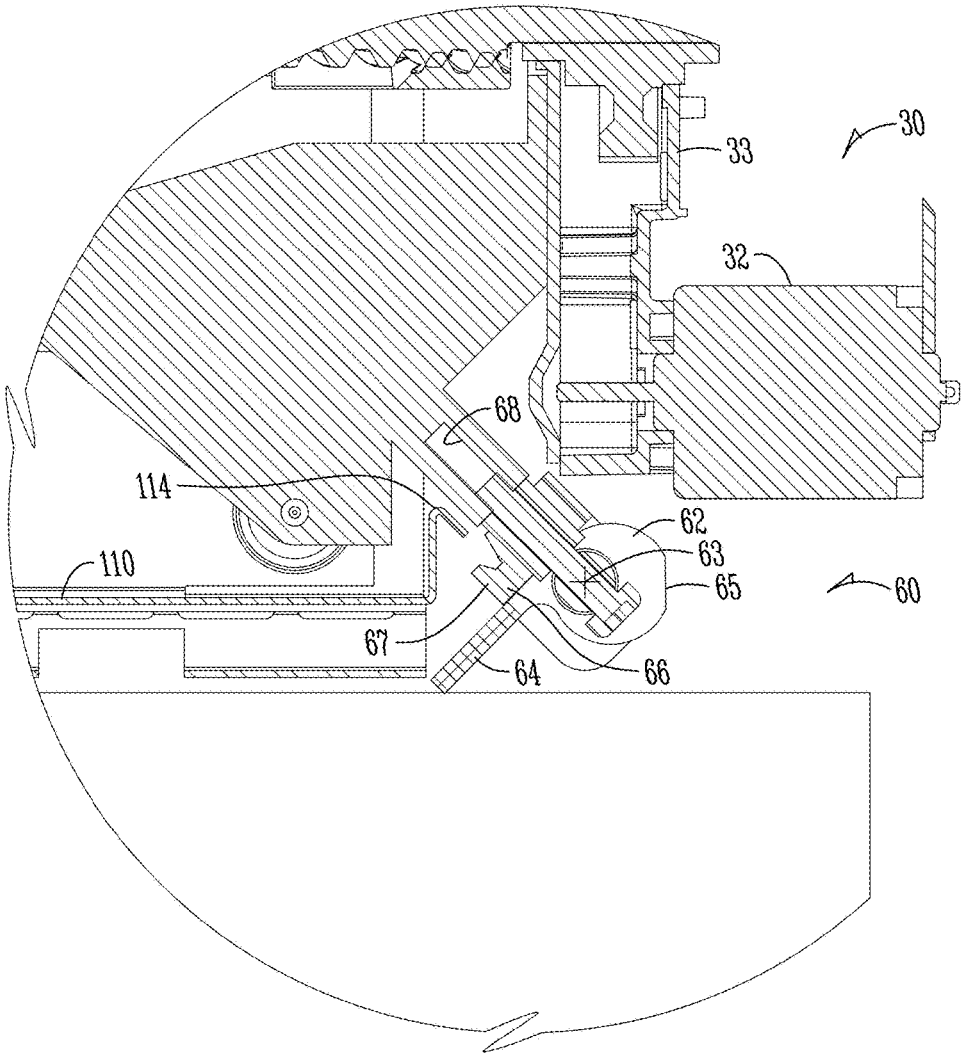

FIG. 5D is the same as FIG. 5B except showing in section along line 5D-5D of FIG. 5C how a manually operable lever can turn the eccentric cam to an unlocked and separated position from the tray.

Figure 6A:
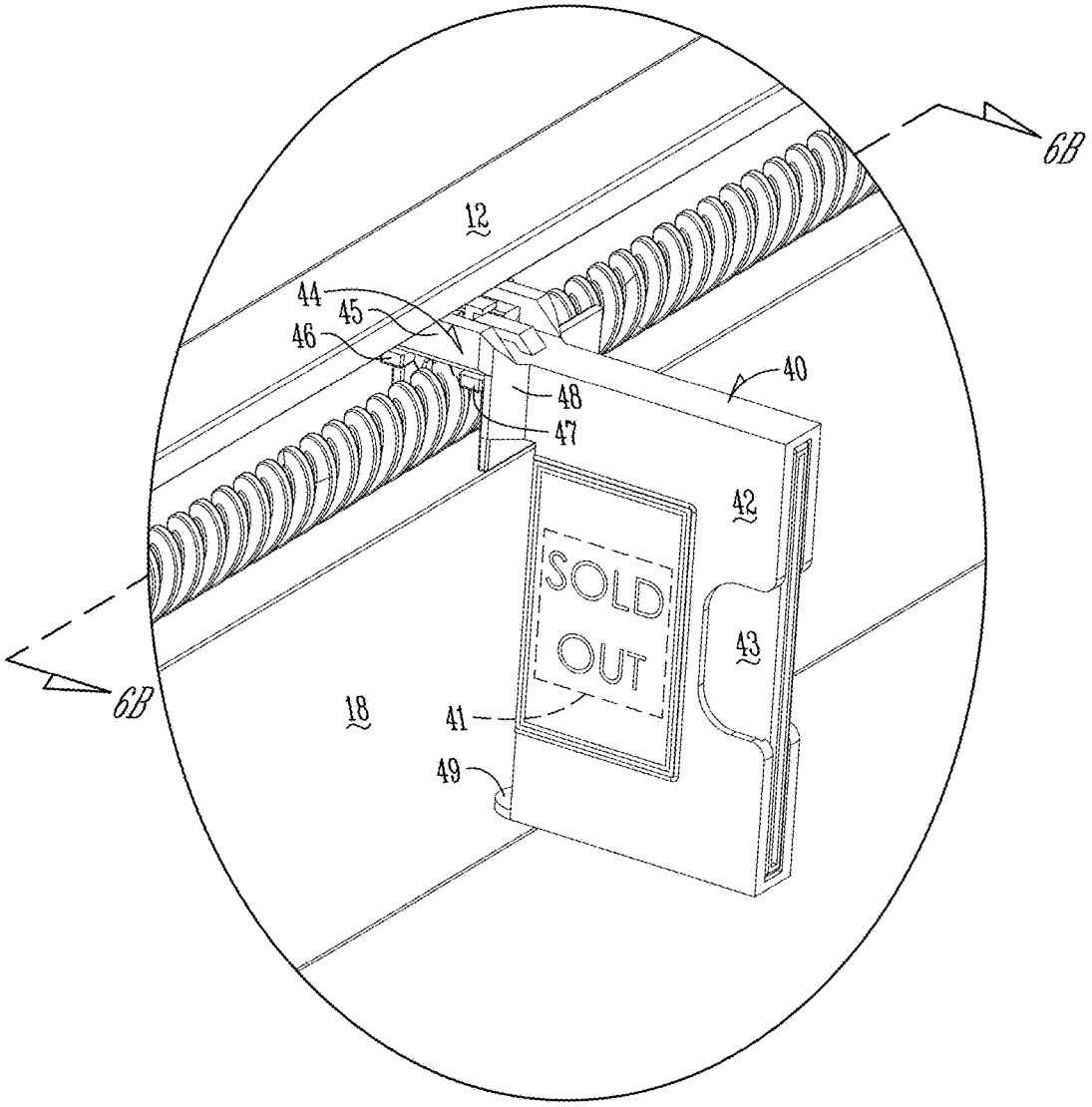

FIG. 6A is an enlarged perspective of what is indicated at line 6A-6A of FIG. 3, showing the push plate of the module and its attachment to a lead screw that extends along the elongated member between motor and front retaining member.

Figure 6B:
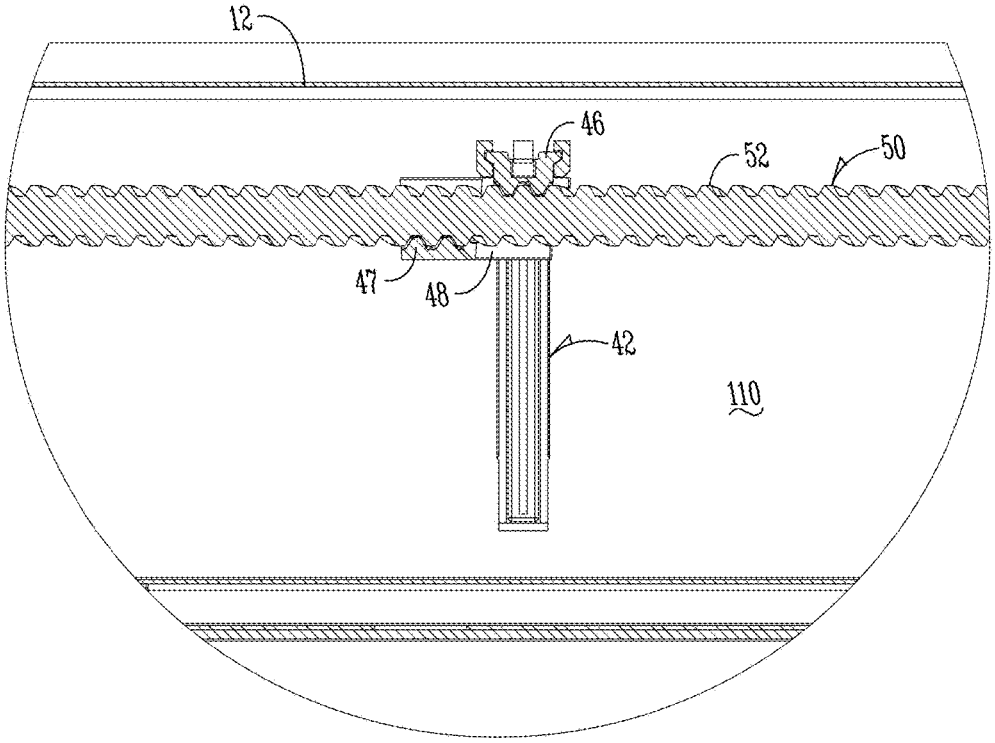

FIG. 6B is an enlarged sectional view taken along line 6B-6B of FIG. 6A.

Figure 6C:
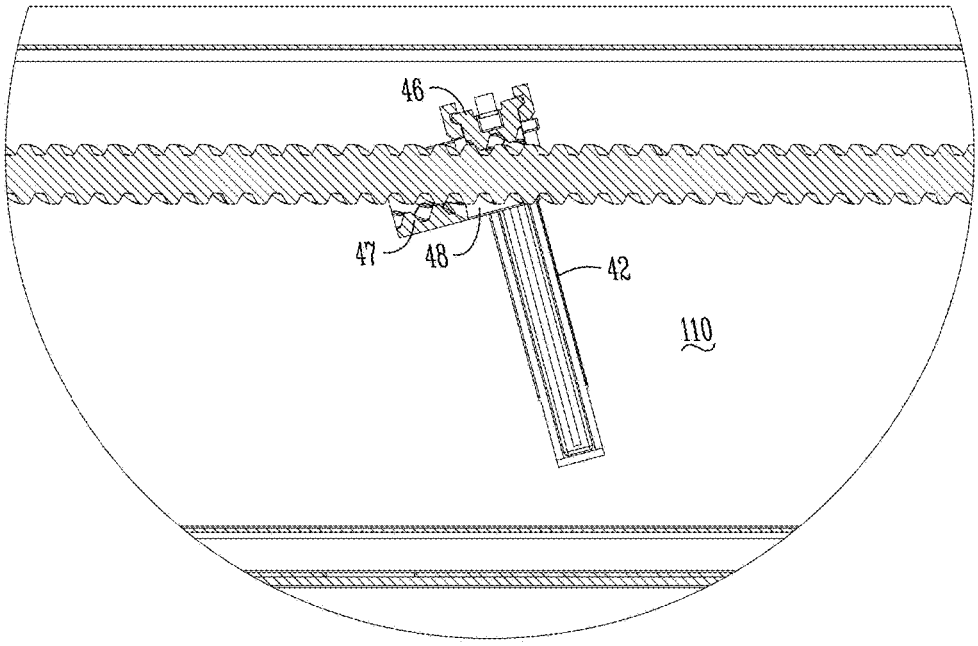

FIG. 6C is as sectional view similar to FIG. 6B except showing how the push plate assembly can be tilted rearwardly while on the lead screw. This allows, for example, the push plate assembly to be released sufficiently on the lead screw to slide it rearwardly to a home or starting position to allow re-stocking of the row.

Figure 6E:
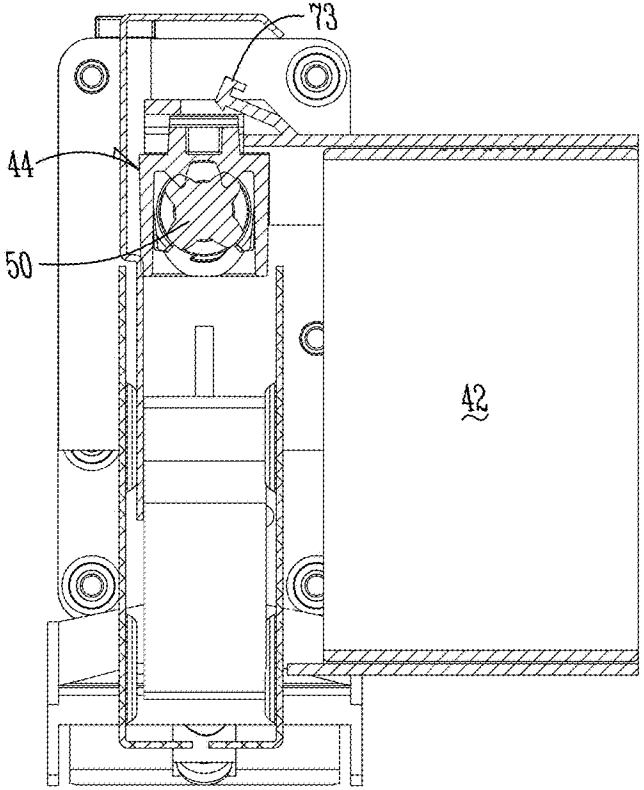
Figure 6D:
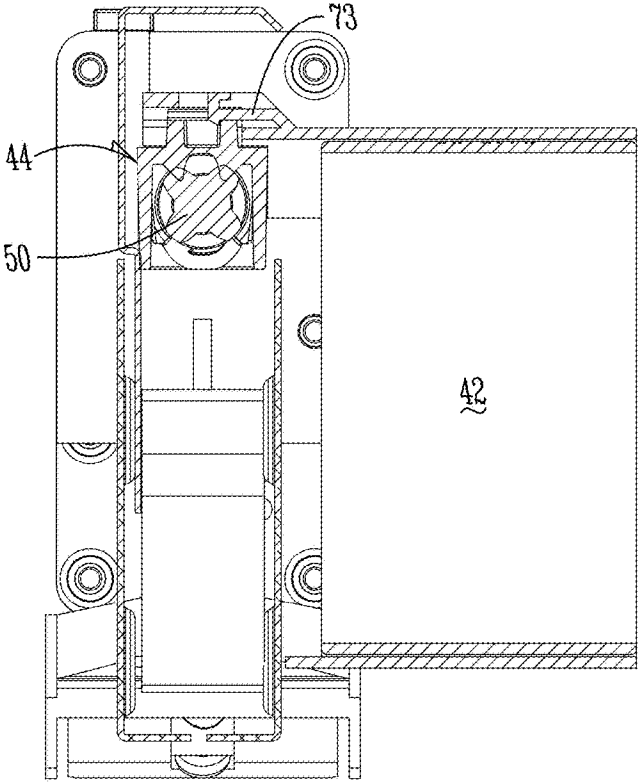

FIG. 6D is a vertical transverse sectional view across the module and lead screw showing how the push plate assembly can be locked on but then lifted off the lead screw. This allows, for example, the push plate assembly to be disengaged and then reengaged on the lead allowing the push plate to be positioned to the back of the module for loading.

FIG. 6E is the same sectional view as FIG. 6D but showing how a manual lever releases the pusher plate assembly so it can be completely removed from the carriage to then be reversed on the opposite side of the module for opposing dispensing.

Figure 1A:
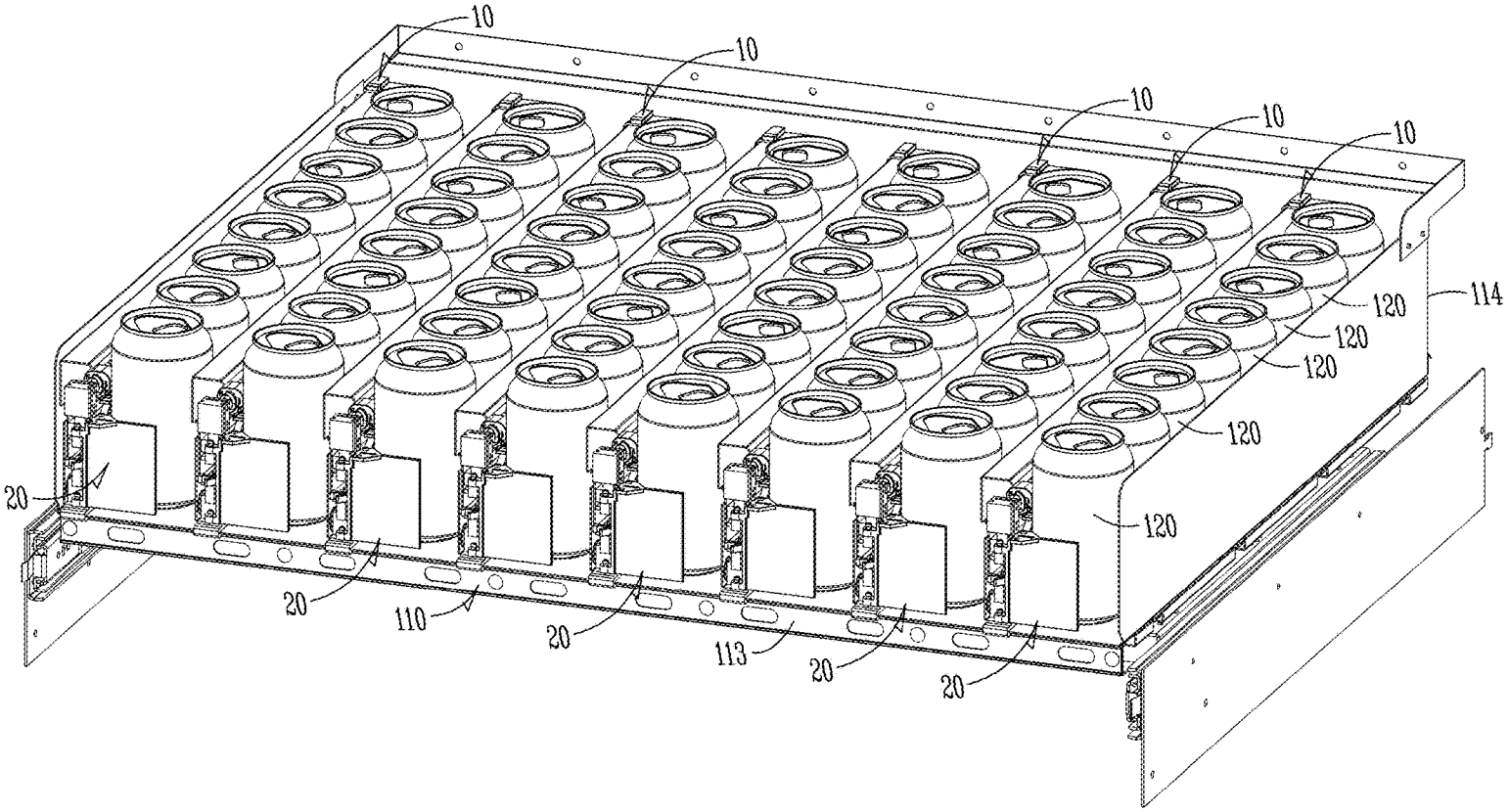
FIG. 1A is a perspective view of multiple (here eight) dispensing modules according to one exemplary embodiment of the present invention, installed on a horizontal dispensing tray, such as would be mounted in a vending or dispensing machine, with a row of product inventory (here beverage cans) held in position in a row at each dispensing module.
Figure 1B:
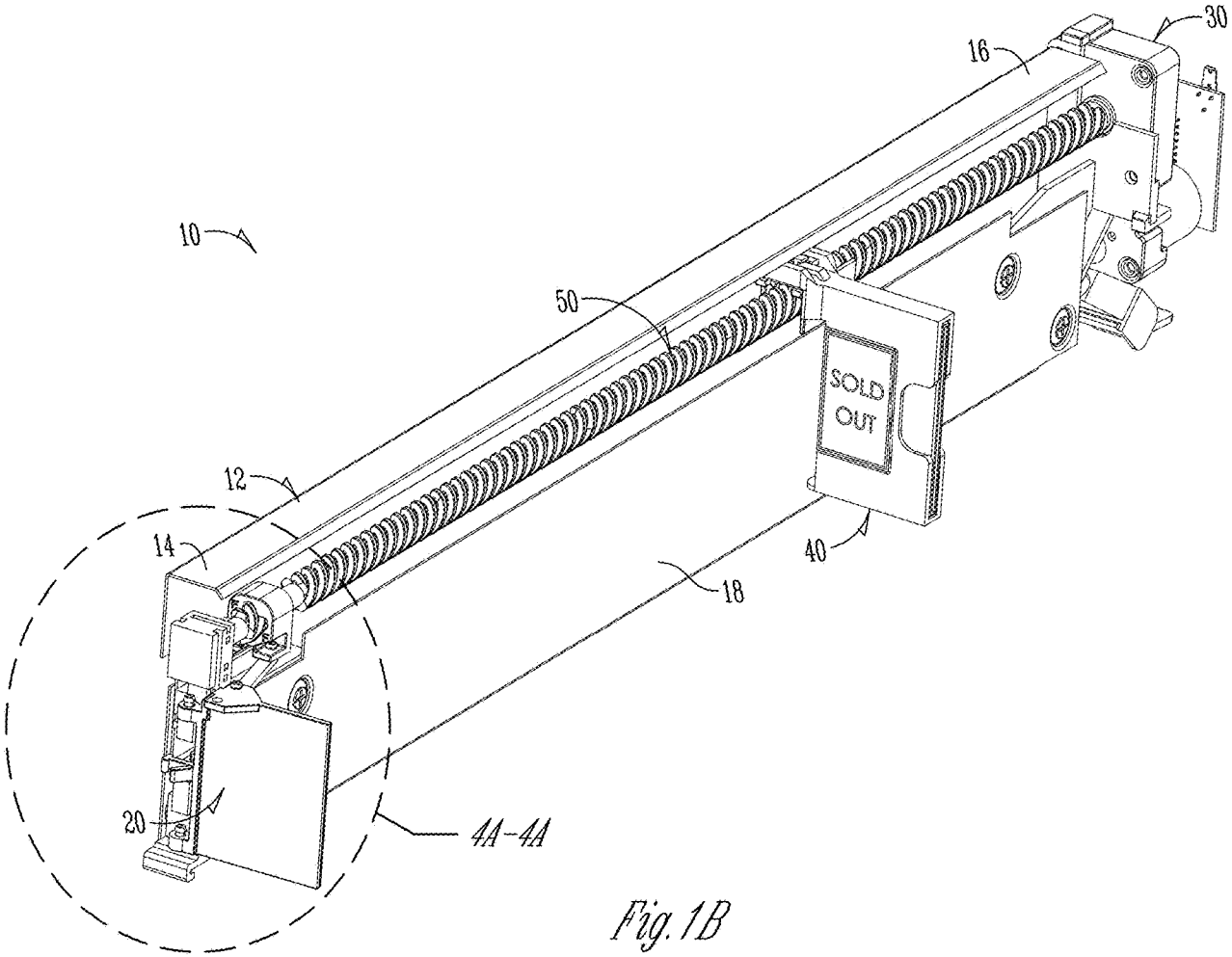
FIG. 1B is an isolated enlarged perspective view of one of the modules of FIG. 1A showing a front gate or retaining member in closed or blocking position and a push member or plate moved forward towards the gate.
Figure 7A:
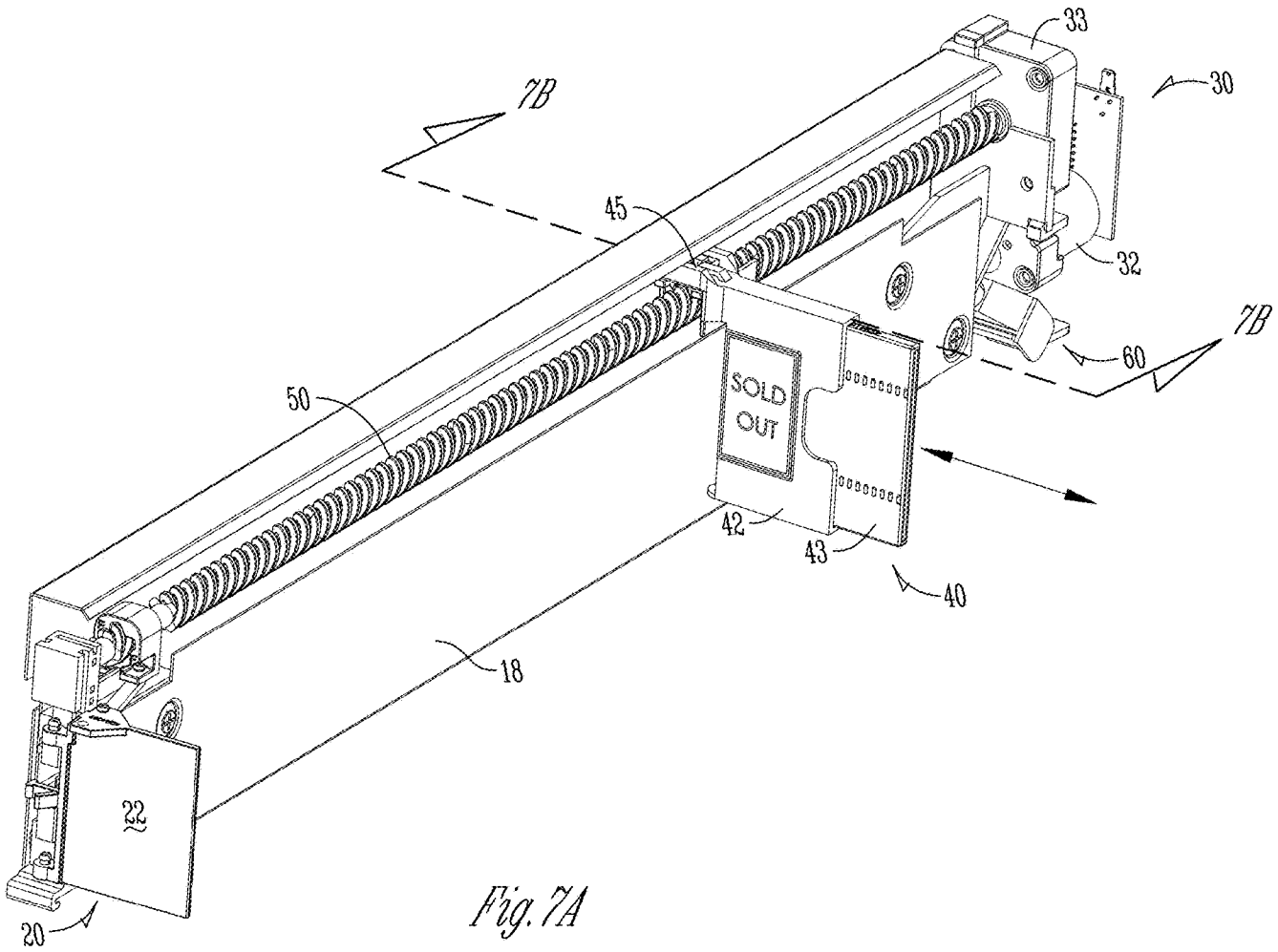

FIG. 7A is a perspective view similar to FIG. 1B for the purposes of showing an expandable push plate in an expanded or extended configuration to selectively and adjustably increase its width.

Figure 7B:
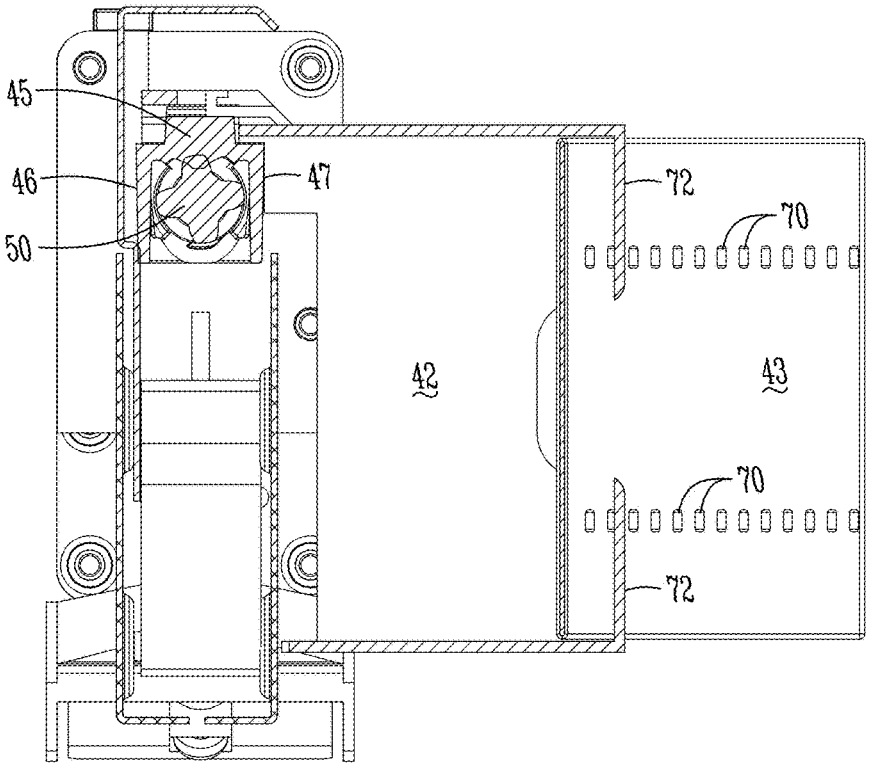

FIG. 7B is an enlarged sectional view taken along line 7B-7B of FIG. 7A showing how two horizontal and parallel rows of nubs or bosses on the exterior of the extension cooperate with edges in the push plate to allow a ratcheted, selectable fixing of amount of extension of the push plate.

Figure 8A:
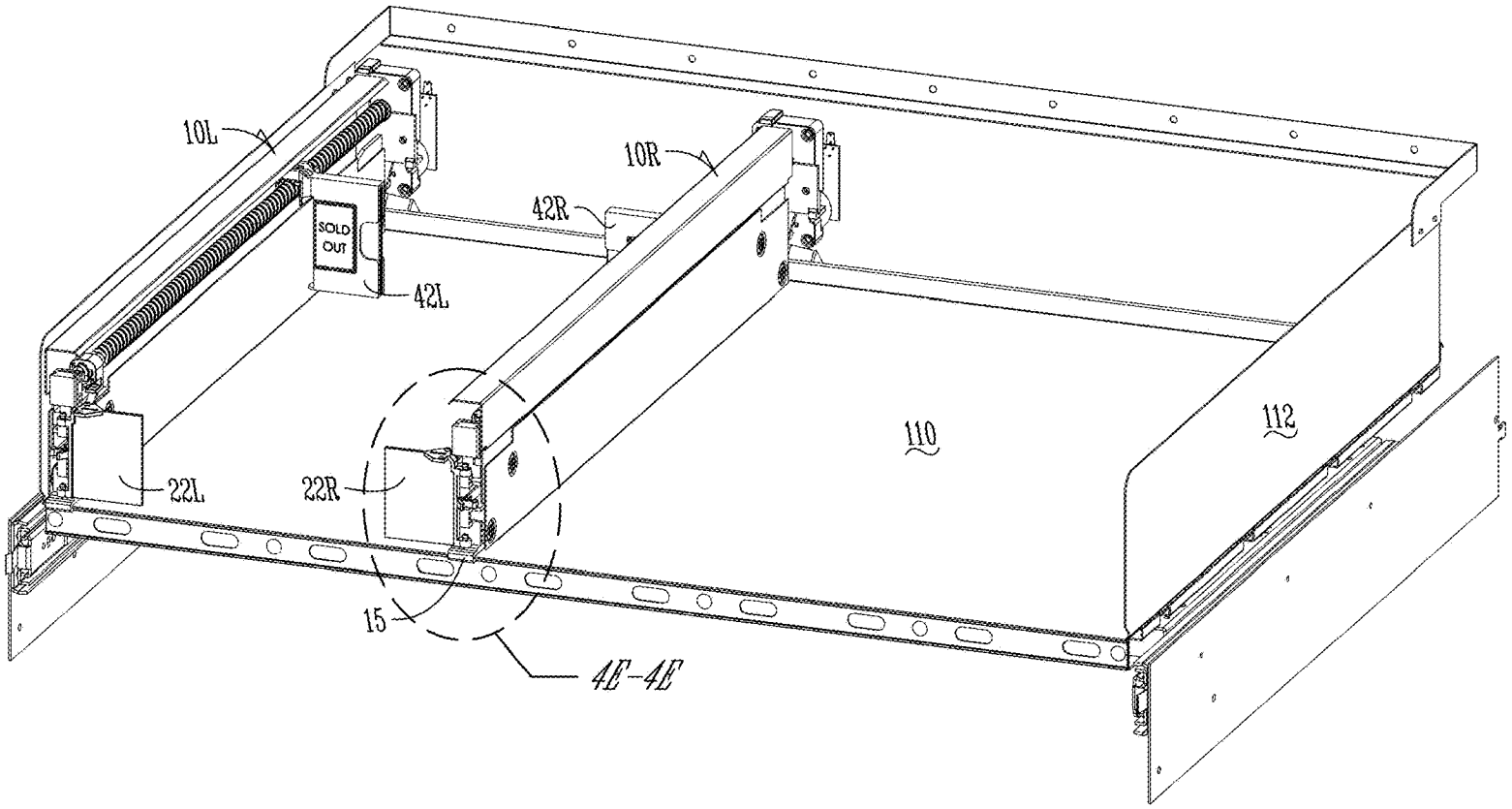

FIG. 8A is a perspective view of a pair of modules on a tray configured for coordinated operation with gates of each module in closed positions.

Figure 8B:
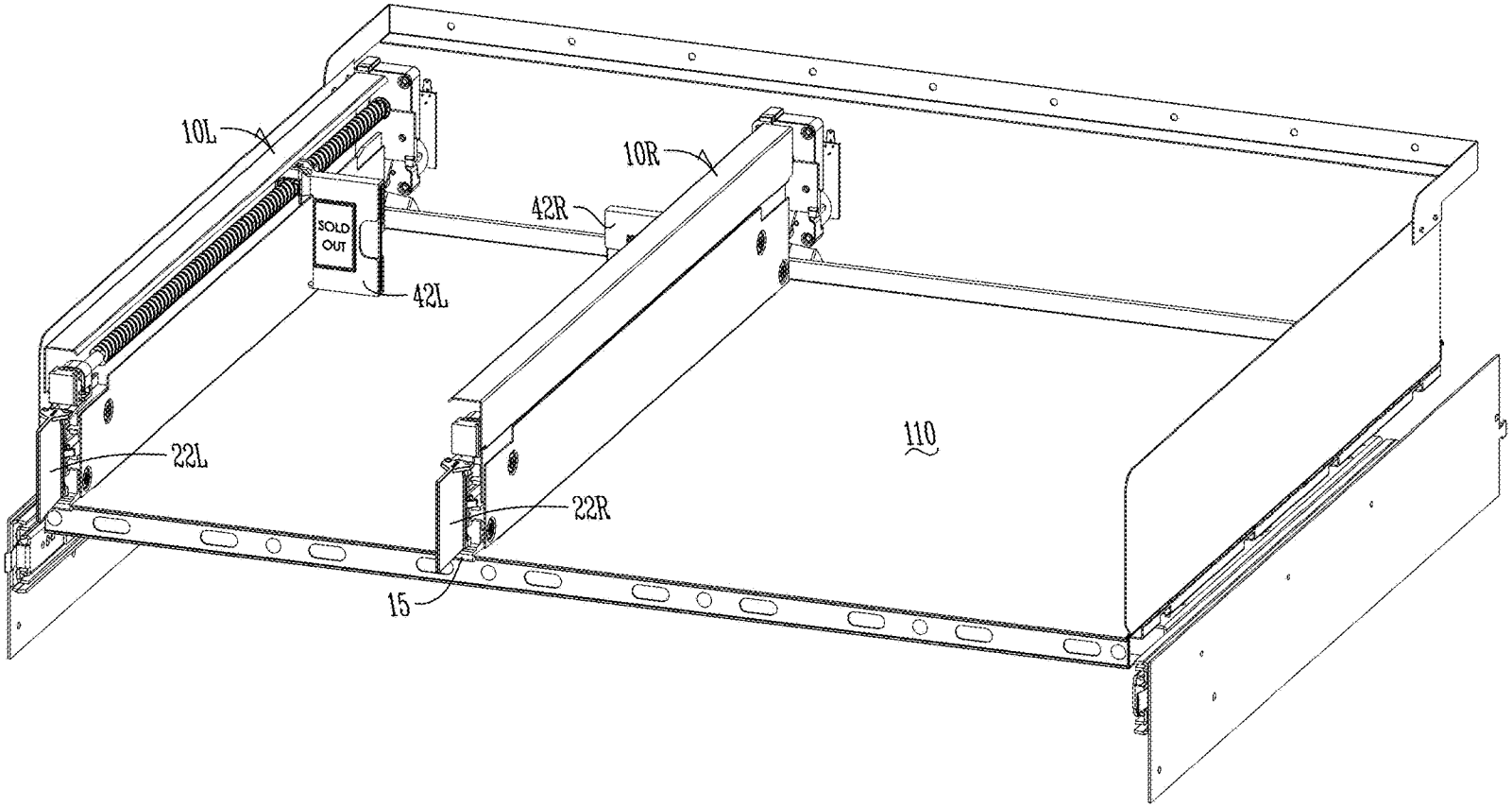

FIG. 8B is similar to FIG. 8A but showing how the front gate members would be coordinated to open for dispensing from the pair of modules.

IV. DETAILED DESCRIPTION OF EXEMPLARY EMBODIMENTS

A. Overview

For a better understanding of the invention and its aspects, several embodiments will now be described in detail. It is to be understood that these specific embodiments are neither exclusive nor inclusive of all the forms and configurations the invention can take.

These specific examples will be discussed in the context of mounting dispensing modules on a horizontal dispensing tray inside a vending or automated merchandising machine, such as are well-known in this industry. One example of such a tray 110 with a plurality of exemplary embodiments of dispensing modules 10 according to the invention is shown FIG. 1A. In FIG. 1A each module 10 is fully stocked with items to be dispensed. Here the items are beverage cans 120 supported by tray 110 at their bottoms in single rows between front edge 113 and back edge 114 of tray 110. A single dispenser module 10 on tray 110, without cans 120, is shown in FIG. 3. As will be appreciated by those skilled in the art, one feature of the modules 10 is that they can operate with a variety of dispensable items. Beverage cans are but one example. The form factor of the items to be dispensed can vary substantially. For example they can be cylindrical (like cans 120) but of a variety of diameters and height, as well as weight. They simply have to be able to be loaded serially in each row, and be able to be pushed forward as a row so that once in abutment with one another, the row can be pushed from the back to dispense the front-most item from the row until the row is exhausted. The form factor can therefore include regular and irregular three dimensional shapes. This can include food and beverage, candy, or other items such as packaged industrial tool bits, packaged medical supplies, and bottles of aspirin, as just a few non-limiting examples.

FIGS. 1A, 1B, 1C, and 3 show that each module 10 has the following main subassemblies.

First, an elongated wall 18 between front and rear ends 14 and 16. Wall 18 serves to essentially be the body of module 10. As will be appreciated, wall 18 can be different configurations. As shown in the drawings, here wall 18 is several basically parallel sheets or plates. Wall or walls 18 not only support the drive system, as shown in FIGS. 1A and 3, they also serve as dividers, guides, and vertical supporting walls for rows of items 120. Opposite sides of each module are such dividing/guiding/supporting surfaces for both the row the module is dispensing and that of an adjacent module. As can be seen in FIGS. 1A and 3, in some cases a vertical wall of the tray is used as one of the opposite guides for a row (here a side wall 112 of tray 110 is used in this manner. As will be appreciated, other support walls could be used, as in the case where the entire width of the tray is not occupied by modules 10.

Second, a drive system extends between ends 14 and 16. In this embodiment, the drive system includes a lead screw 50 with is rotated by a motor subassembly 30 at the back of each module 10. Lead screw 50 is rotatably supported in a front bearing block 51 (see FIG. 4A). A reversible shield or cover 12 can cover lead screw 50.

Third, a push plate subassembly 40 includes a laterally extending push plate 42 (see FIG. 6A). A lead nut or carriage 44 (FIG. 6A) rides on top of lead screw 50, intermeshes with the threads around the top and opposite sides of lead screw 50, and thus rotation of lead 50 moves push plate subassembly 40 fore or aft depending on direction of rotation of lead screw 50 by motor 40. A feature of this embodiment is that push plate 42 is connects to carriage 44 and is stabilized along wall 18. The mass of push plate 42 thus seats carriage on lead screw 50 and uses gravity to keep complementary threaded portion on the interior sides of carriage 44 with the exterior threads of lead screw 50. When intermeshed, carriage 44 essentially is a lead nut on lead screw 50. The shield or cover 12 can be removeably mounted (e.g. by a few screws to the module wall 18) over lead screw 50 to shield it and help maintain carriage 44 in place. However, the bottom of carriage 44 is intentionally left open. It does not wrap all around lead screw 50. If shield 12 is removed, carriage 44 can thus be simply manually lifted up to remove it and push plate 42. It can be flipped end-to-end and reinstalled with push plate 42 extending from the other side of wall 18 and cover 12 replaced. This allows quick conversion of the same module 10 between configurations of push plate 42 extending in either lateral direction (as indicated by push plates 42L and 42 R in FIG. 8A).

Fourth, an optional gate subassembly 20 can be included at the front of module 10.

It can block the path of the row of items 120 until the dispenser intends to dispense the front-most item. At that time, gate 22 (see FIG. 4A) can be automatically opened to unblocking position to allow dispension. It can then be automatically returned to closed or blocking position. This can help in orderly dispensing. It can also help retain items in the row if the machine holding the tray or module is tipped or shaken, or if the tray is moved or tilted, as can be the case when restocking.

Such trays can be installed inside vending machines at different vertical levels. They have a width (generally across the interior space of the cabinet) and front and back edges defining a front-to-back length. One or more dispensing units can be mounted in each tray. However, the invention is not limited to these trays or machines.

Figure 2:
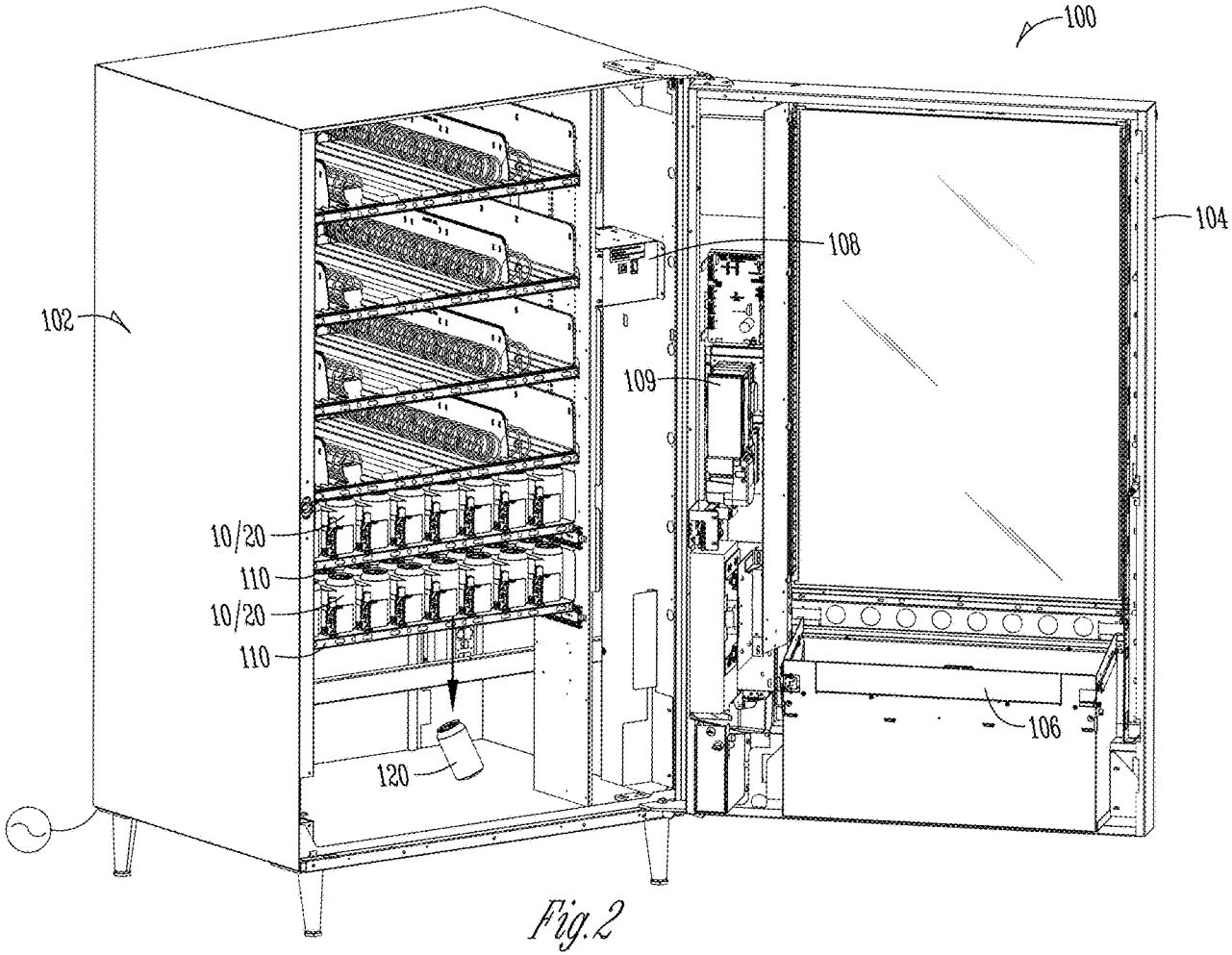
FIG. 2 is a perspective illustration of multiple trays in a dispensing machine, where the lowermost two trays include the dispensing modules of FIG. 1A but the upper four trays have other types of dispensers (here examples of helical-wire-based dispensers).

The examples in the description below will be in the context of inventory which is advanced forwardly in an automated merchandizing machine 100 (see FIG. 2) such that the foremost or front-most item in a row of any of the dispensing modules 10 can be pushed off the front edge of its tray 110 and be dispensed. As illustrated in FIG. 2, one example is the dispensed object 120 falls by gravity along an unobstructed drop space (see arrow showing trajectory) to a delivery bin for user or customer access. In this figure, machine 100 includes a cabinet 102 with glass front door 104, and a bin 106 to receive any items gravity-dropped from any of the dispensers (including those that are other than modules 10) would catch then when door 104 is closed. However, the invention is limited to gravity-drop dispensing. There could be other techniques for receiving the front-most item once pushed from the module. One example is US US2012/0277904A 1 to inventors Pritchard, Mayoros, and Lad, incorporated by reference hereto, which moves the front-most items in a row into an elevator tray moved to the front edge of the dispenser. The elevator than moves the dispensed item to an access location.

The examples will also be described in the context of vending or dispensing machines that include what will be called a vending machine controller (VMC) that can be programmed to instruct operation of an actuator at each dispensing module. This can control the direction and amount the push member is moved. One specific example is by the amount and direction of rotation of a lead screw of each module. However, the invention is not limited to these specific arrangements.

It is to be understood, however, that the invention is not necessarily limited to any of these specific contexts. As discussed in the Background of the Invention, the exemplary embodiments could be utilized outside of any cabinet or vending machine. For example, in the context of micro markets or otherwise, the invention could be mounted to a wide variety of displays or support structures. Non-limited examples are open rack displays, in-wall displays, glass front displays, shelving, and racks. The examples below are non-limiting illustrations of just some forms and applications the invention can take.

B. Exemplary Module

FIG. 1A shows a dispensing module 10 according to one embodiment of the invention. An elongated walled member 18 has first and second opposite ends 12 and 14, a bottom and top 12, and what will be called a proximal side and a distal side.

It is to be understood that one feature of module 10 is the ability to configure it between two states. A first state has an actuator mounted at the first end and a gate assembly at the second end. When installed on a support (such as a tray 110), a push member 42 extends laterally from the proximal side of the elongated member. By proximal side it is meant the side closest to a row of items to be dispensed. In the case of FIG. 3, the push member extends to the right (in the illustration and relative to the tray 110 module 10 is mounted on). The actuator (motor subassembly 30) is at the back and the gate (gate subassembly 20) is at the front. However, the push member (push plate subassembly 40) and gate subassembly can be switched between opposite sides of the elongated walled member 18 of each module 10. This reconfiguration would allow module 10 to have the push plate and gate subassemblies extending an opposite direction from that of FIG. 3 (see, for example, the right-most module in FIG. 8A). Because of this quick and easy convertibility, and the essentially stand-alone, self-contained nature of each module 10, the installer can decide which configuration state to use each module and accomplish the same quickly, with only a few tools, and without additional parts.

Another feature of adjustability is the ability to quickly mount and fix a module in place on a support (e.g. a tray or shelve or the like), as well as adjust it on that support or relative to other modules or dispensers on that support. The self-contained nature of each module allows this, as well as with a reversible mounting system, as will be explained further below.

Referring to FIGS. 1A-C and 3, a specific exemplary embodiment of a module 10 is shown in detail. In this first configuration, module 10, as mounted, extends between a front end 14 and back end 16 of module 10. An intermediate walled portion 18 presents essentially a vertical wall at its proximal side. Retaining member or gate subassembly 20 is installed at front end 14. The actuator here is an electric motor unit 30 (motor 32 and gear box 33) and is installed at the back end 16. A transversely mounted push member subassembly 40, here with plate 42, is operatively connected to a drive member, here lead screw 50, between motor 30 and the front end 14.

As will be further discussed below, module 10 can include a mounting system at front and back 14 and 16 for connection at front and back edges 113 and 114 of a dispensing tray 110 (see also FIGS. 2 and 3).

As illustrated in FIG. 1A, plural modules 10 can be adjustably mounted across the width of tray 110. The wall shape of the elongated body 18 of each module functions as a retainer wall for adjacent modules 10. Alternatively, as shown by the right most module 10, an end wall 112 of tray 110 can also serve as an opposite wall for retaining that row of inventory.

Figure 1C:
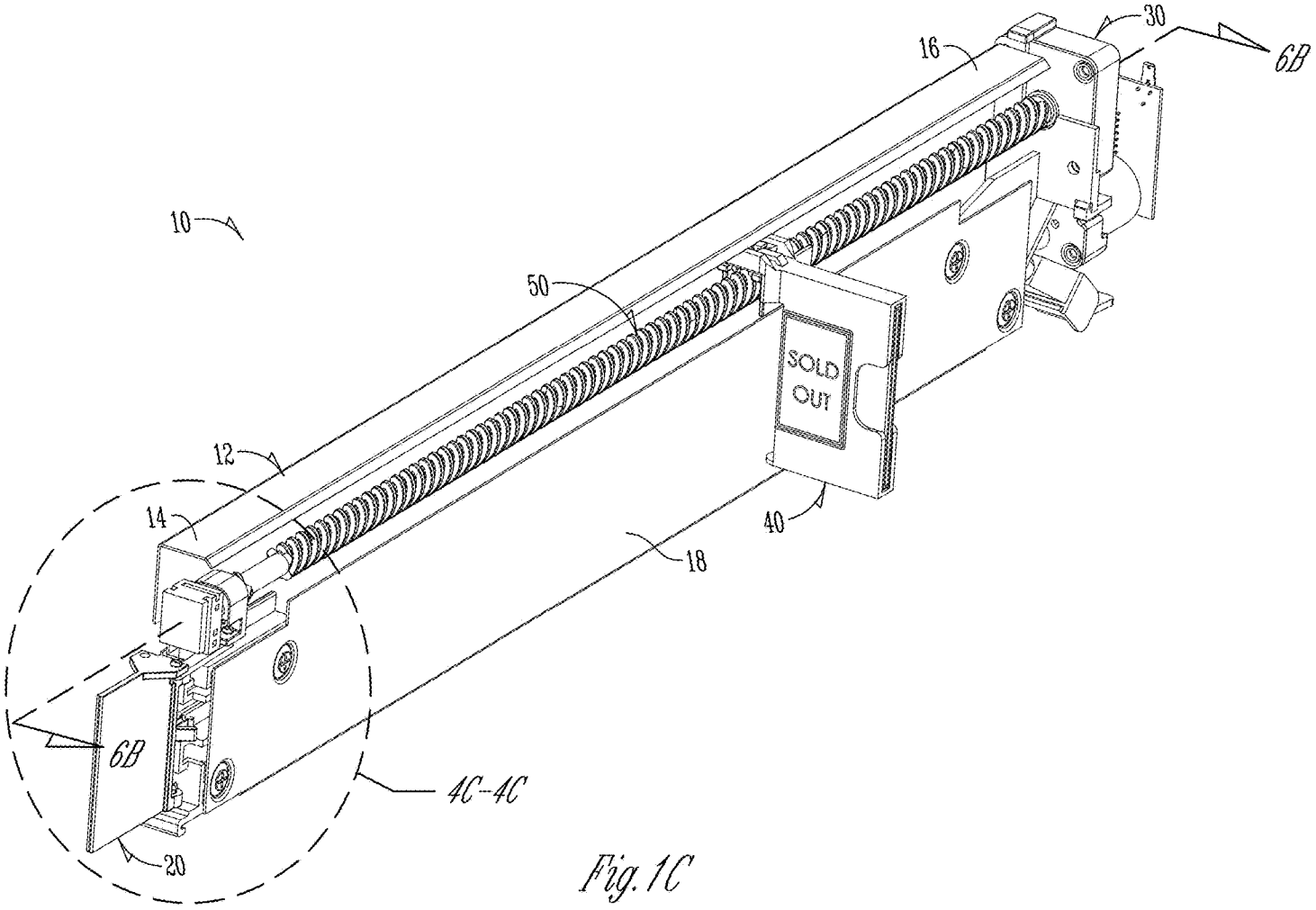
FIG. 1C is identical to FIG. 1B except showing the front gate in an open or unblocking position.

FIGS. 1B and 1C illustrate how the front retaining gate member 20 can be pivoted open to provide for release of a foremost object of inventory to be pushed and dispensed. As will be discussed further below, in this embodiment retaining gate member 20 opens and closes by coordination of a special section of the lead screw and the forces of the row of inventory pushing against it.

FIG. 2 shows one context of application of the modules. A vending machine 100 can include a cabinet 102 with a lockable glass front door 104. A delivery bin 106 at the bottom of an unobstructed drop zone at the front interior space of cabinet 102 catches dispensed products from any of the dispensers of the trays 110, including from any of modules 10.

An example of a commercially available machine of the type of FIG. 2 is a model AB 45/304 food and beverage merchandizer available at Vending.com. It includes a programmable vending machine controller 108 and a bill/coin/credit validator 109, such as are well-known in the art. An example of such an automated merchandizing machine is commercially available model number AB 45/304 food and beverage merchandizer (see http://www.vending.com/files/2015/05/AB45_304-5WSZ.pdf). VMC 108 can be operatively connected between a bill/card reader validator and each of the dispensing modules (and other dispensers) and operate them according to well-known principles to those skilled in the art. For example, VMC 108 can be programmable with respect to how a motor would rotate each lead screw 50. This includes speed, duration, and direction.

FIG. 3 shows one mounting position for module 10. In this configuration module 10 is at the left side of the tray 110.

FIG. 3 also illustrates a feature of the invention. As known in the art, helical dispensers, such as shown in the upper trays in FIG. 2, are a popular type of dispenser. However, as can be seen, individual products must be able to fit within each turn of the coil. Rotation of the helix advances the row. In comparison, module 10 essentially has unobstructed space between front and back, except for the push plate 42. It does not require the form factor of dispensable products to fit within any coils. It also frees up space that would otherwise be taken by the coil, so that more space is available for inventory. An age-old issue in this technical field is the desire to have as much inventory space inside the cabinet as possible to minimize the resources that must be used to restock inventory. Modules 10 promote this by eliminating helical coils and providing unobstructed space laterally from the proximal side. And because the method of moving the row of items forward is pushing from the rear of the row, still further space is freed up.

As can be appreciated (see FIG. 1A), multiple dispensing modules 10 can be installed in adjustable positions across the width of tray 110. They can also be installed with other dispensers such as helical or others on the same tray.

As will be appreciated by those skilled in the art, the Figures illustrate roughly one scale of module 10 relative to a typical full size vending machine such as Model AB 45/304 referenced above. However, as will be appreciated by those skilled in the art, module 10 and its components can be scaled up or down according to need or desire within practical limits. For example, the illustrated embodiment can be made of materials that can cumulatively weigh no more than a couple of pounds and can push a full row of inventory of on the order of 15 pounds. But it is to be understood that this range could vary according to design. Also, the elongated body of module 10 can be made of a variety of materials. In this example it is primarily made of plastic components (e.g. Delrin®). It can also include sheet metal components. Push plate 40 could be made of metal but also of plastic, as could retainer member 20, and even lead screw 50 and the threaded components that respond to it. The designer would select appropriate materials for the application.

As further shown in FIG. 3, a typical tray 110 can have a front vertical upward extending edge or lip 113 with or without slots or holes and a similar back edge or lip. In this example a front wire bail, bar, or arm also extends between left and right walls 112 L and R of tray 110. The back of tray 110 includes an edge 114. A back support piece connecting the tops of side walls 112L and R is also shown. These are structural features that can have structural and other benefits. For example the front bail arm can be configured to help knock down the foremost dispensed product, for example if it is tall and it would help cause its bottom end to drop by gravity.

1. Elongated Wall or Body 18

As can be appreciated, elongated member 18 in this example is essentially a long, thin housing of double walls of plastic or metal sheet. When assembled, it is basically a vertical wall. A top cover 12 over lead screw 50 can shield it from not only access by humans but also from debris. Other features of body 18 will be appreciated from the drawings. Member 18 is thin in width versus length so that it occupies minimum space on a tray or other support; again to promote efficient use of space. Here width is on the order of 2.5 inches and length on the order of 25 inches. This can vary according to need or desire of the designer.

In this example, the height of elongated member 18 is approximately 4 inches. This can also vary according to need or desire of the designer. This was selected as beneficial for the types of items typical of conventional automatic merchandising machines.

Of course, dimensions of module 10 will be informed at least partially by such things as the front-to-back length of the support (e.g. tray) on which it is to be mounted, the width of the support, and the vertical distance to other supports, dispensers, or components in the cabinet.

The proximal side of housing 18 (the side with push plate 40), is proximal the row of items to be dispensed. The distal side is its opposite vertical side (away from the row of times to be dispensed).

Other features of elongated member 18 are as follows.

Front end 14 is configured to receive gate subassembly 20 and support the front end of lead screw 50. It also includes hook 15 associated with mounting module 10 to front edge 113 of tray 110.

Back end 16 is configured to receive motor subassembly 30 (operably connected to and for driving lead screw 50) and clamp subassembly 50 associated with the mounting the back end of module 10 to the back edge of tray 110.

Top and bottom edges of housing 18 are relative to installed position. The bottom edge can abut and ride on top of the tray or shelf it is mounted to. Alternatively, depending on the mounting system, it might be above that surface. The top edge is at a height to reasonable cause the housing 12 to serve as a divider between rows of items to be dispensed.

The proximal side of housing 18 can serve as a guide for one side of one row of items. The distal side of housing 18 can serve as a guide for a second row of items to be dispensed, assuming another dispenser is used. Thus adjacent pairs of modules 10 can help maintain and guide several rows of items.

2. Front Gate

FIGS. 4A-4E illustrate details regarding the front of module 10.

A front hook 15 fits around front edge or lip 113 of tray 110. A part of the mounting system for module 10, it is a mechanical stop against movement of module 10 towards the back edge of the tray. When the back of module 10 is clamped to the back edge of the tray, the whole module 10 is fixed in position on the tray. It cannot move in any direction unless the clamping force is overcome. The designer can select the clamping components to exert a significant clamping force on the tray to resist such movement.

Gate subassembly 20 automatically opens and closes in coordination with lead screw 50.

Gate 22 is pivotally attached to the front end 12 of module 10 along pivot axis 21 between a header 23 and the portion down near hook 21. A pin or screw 24 pivotally attaches one end of a link arm 25 to the proximal side of header 23. The other end of link arm 25 pivotally connects by a pin or screw to a lead nut 26 installed on lead screw 50 near the front end of lead screw 50, which is held in rotation bearing block 51 mounted on the front end 14 of body 18.

Figure 4A:
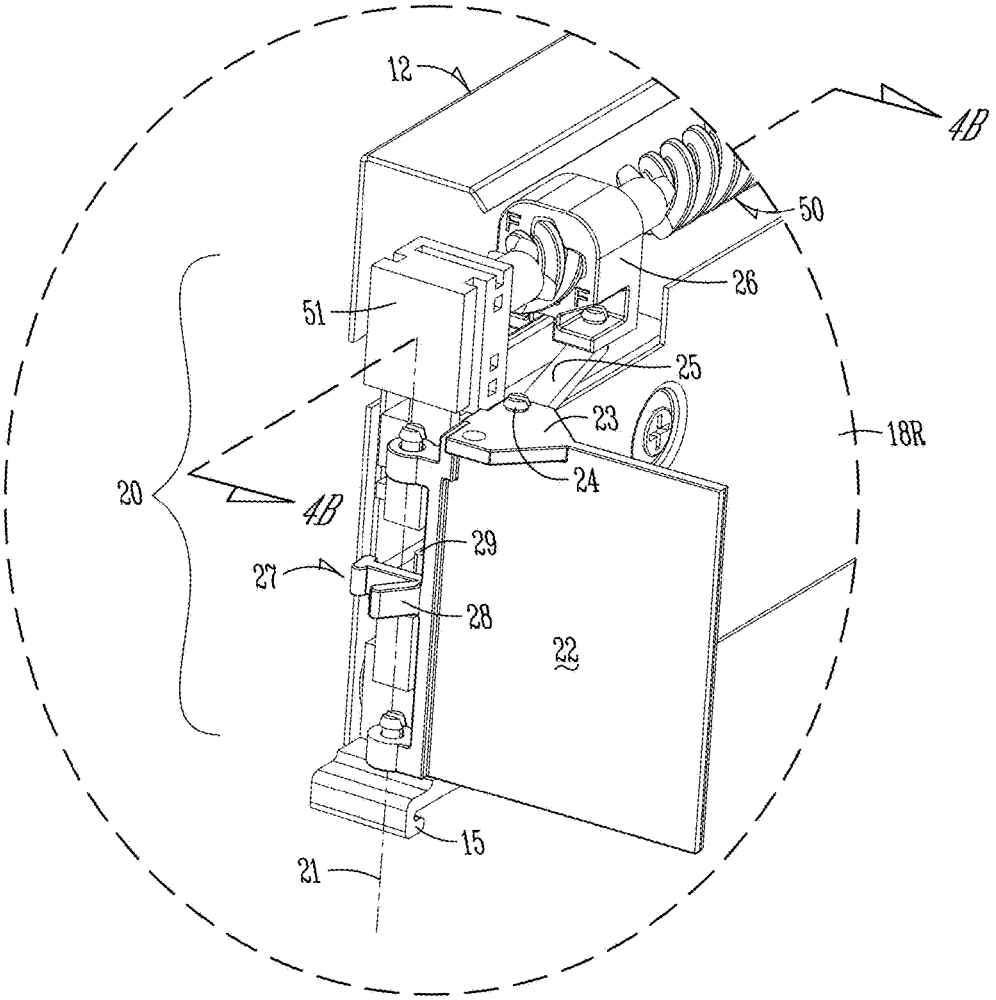
FIG. 4A is an enlarged perspective view taken at line 4A-4A of FIG. 1B of the front retaining gate member of the module.

A biasing member 27 extends from the pivoting vertical edge of gate 22. In this embodiment, biasing member 27 is a piece of resilient plastic formed in the shape of an arrow head and attached to or integrally formed at the hinge side of gate 22 (the arrow head basically points at that rear vertical edge of gate 22). It is symmetrical because it works regardless if gate 22 is installed to be in a closed position to the right (as in FIG. 4A) or to the left (see right module 10 in FIG. 8A). The main part 27 of the biasing combination has a T-shape distal head with rounded corners. FIG. 4C shows a resilient spring arm 29 extends from and is anchored in module 10. It extends so that when gate 22 is in a closed position (see FIG. 4E), one of the arrow head sections 28 serves as a mechanical stop. The distal end of spring arm 29 is basically captured in the triangular area between section 28 and section 27. This keeps gate 22 closed when lead screw 50 is not operating.

Figure 4B:
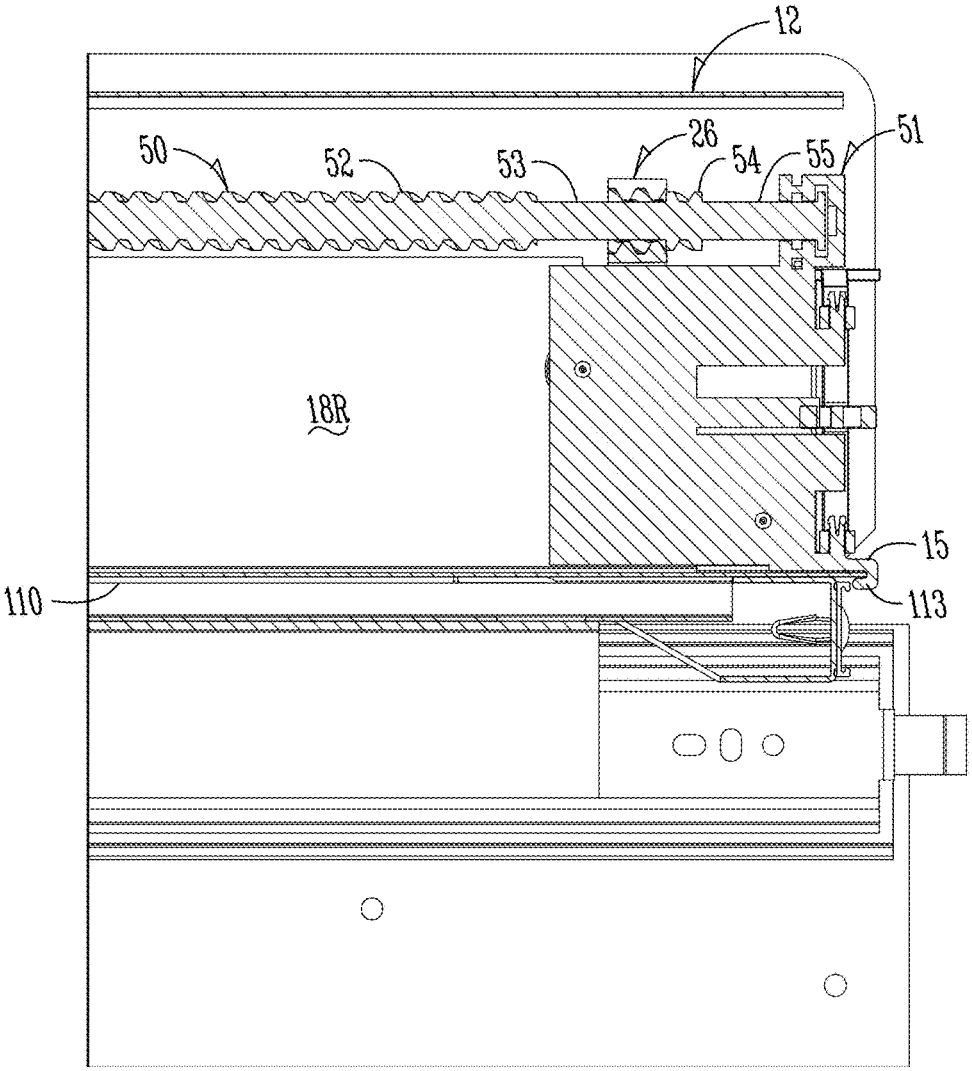
FIG. 4B is a further enlarged sectional view taken along line 4B-4B of FIG. 4A showing how the gate member is biased closed and cooperates with a rotating lead screw of the module to open and close, and also showing a hook member at the front of the module so it can be releasably fixed to a dispensing tray.
Figure 4C:
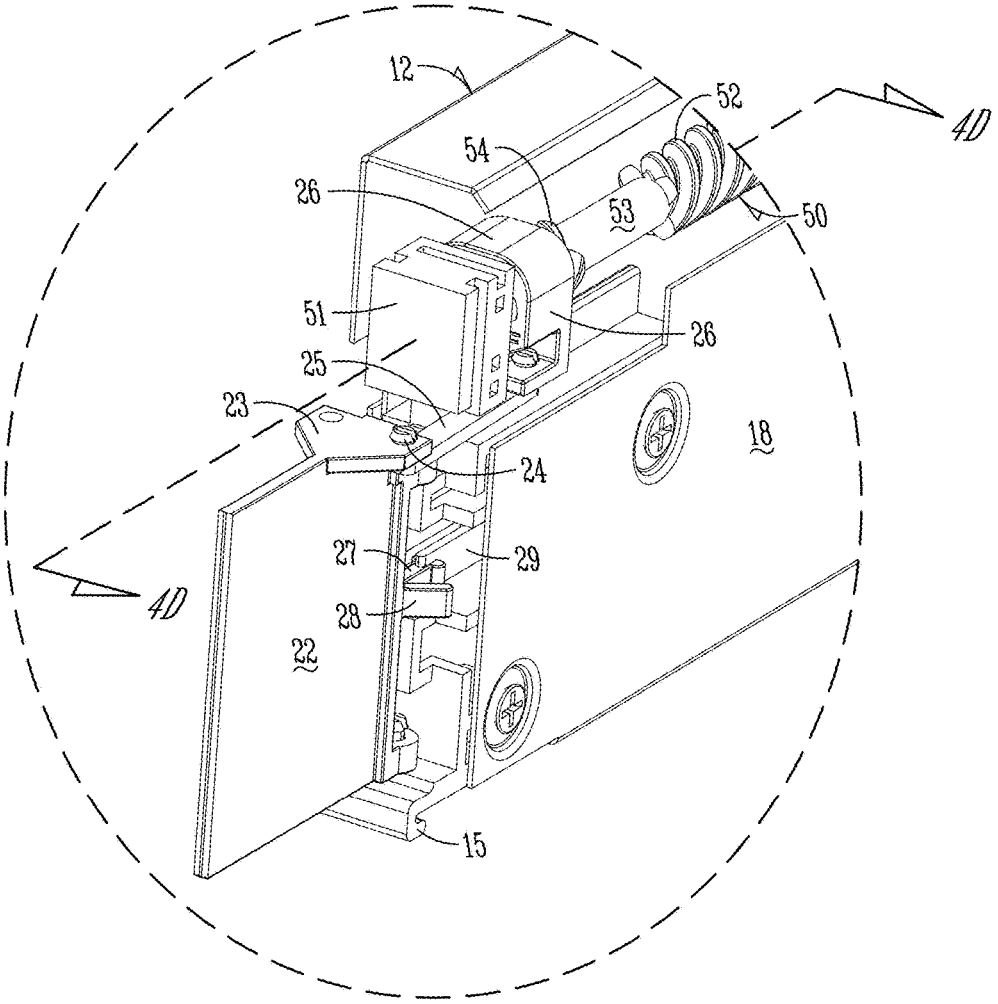
FIG. 4C is like FIG. 4A but an enlarged perspective of the front end of the module with the gate member moved to an open or non-blocking position, and showing a spring biasing combination at the front of the module to bias the door to a closed position.

Lead screw 50 has continuous external threading along most of its length from at its operative connection to motor subassembly 30 in the back to towards the front (see threading 52 in FIG. 4B). The front of lead screw, however, includes a short blank or non-threaded portion 53, followed by a short threaded section 54 (a few threads), followed by another short blank or non-threaded section 55.

Lead nut 26 has internal female-threading that is complementary to the male external threading on lead screw 50.

Figure 4D:
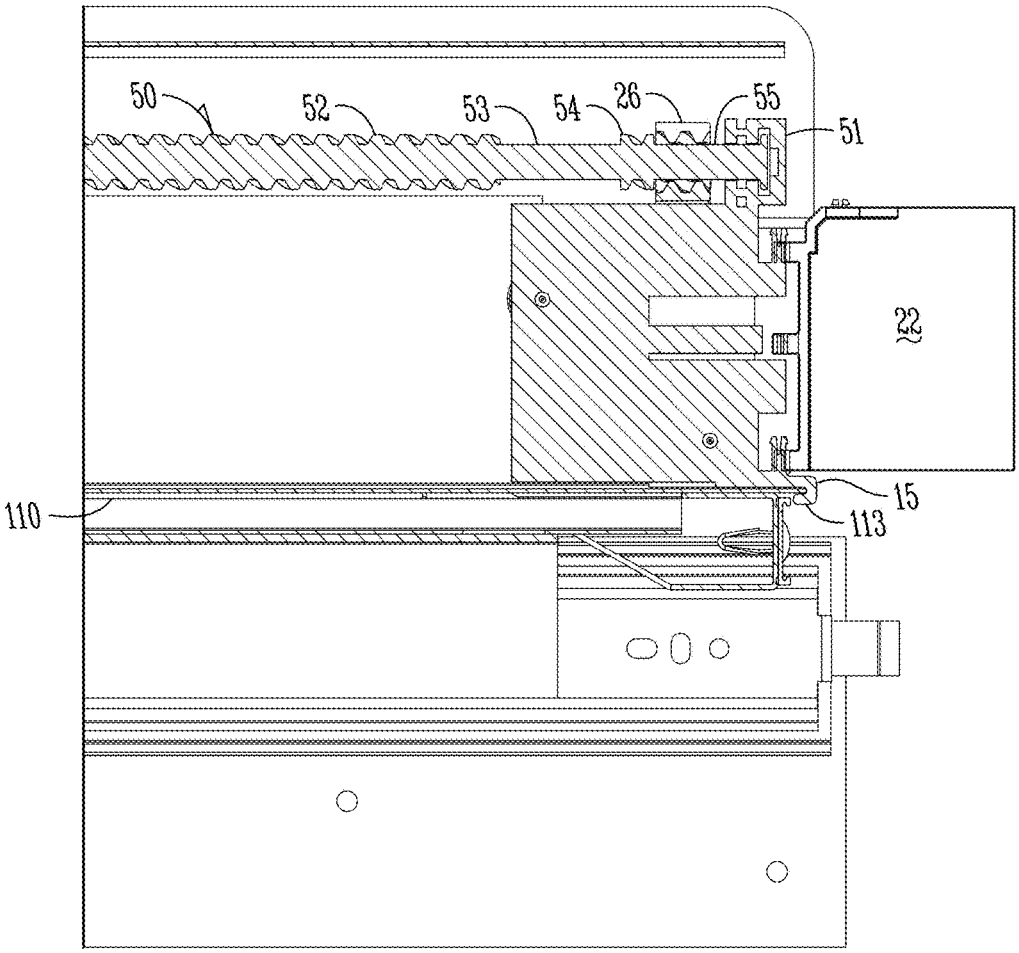
FIG. 4D is a sectional view taken alone line 4D-4D of FIG. 4C.
Figure 4E:
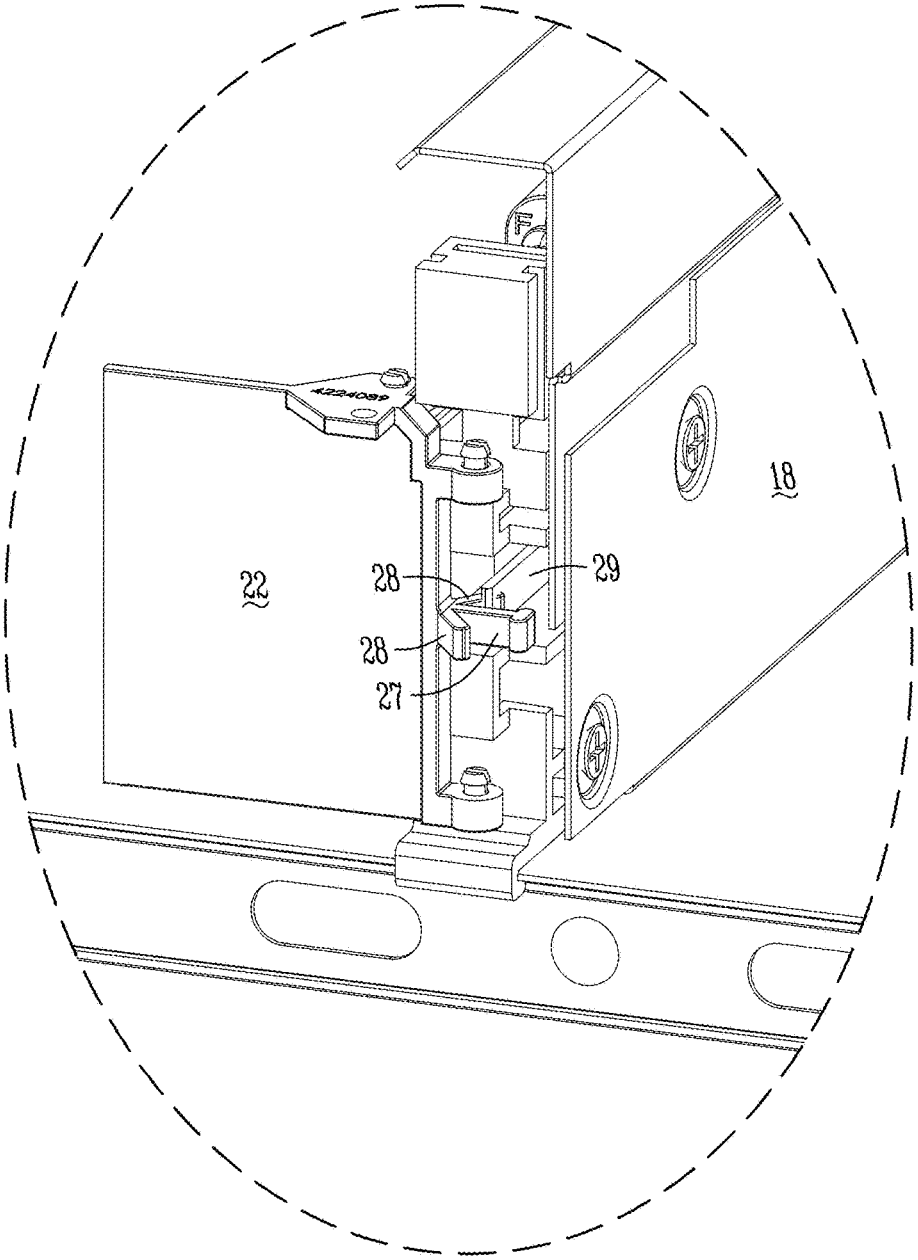
FIG. 4E is an enlarged perspective view of FIG. 8A, showing gates in closed position, and biased by a spring arrangement at the front of each module.

By comparing FIGS. 4A and 4B, with FIGS. 4C and 4D, it can be seen that in the closed or blocking position of gate 22 in FIGS. 4A and B, lead nut 26 is basically aligned with the rearward most part of short threaded portion 54 of lead screw 50. Spring arm 29 and arrowhead member 27 keep hold gate 22 towards its closed position when lead screw 50 is not operating. Thus, gate 22 serves to hold inventory in place in module 10.

However, when lead screw 50 is operated to move push plate 40 forward to dispense the foremost inventory link arm 24 would start pulling gate 22 to open because threaded portion 54 of lead screw 50 would grab lead nut 26 and move it towards the front terminal end of lead screw 50. As indicated at FIG. 4C, this would pull portion 27 of the arrowhead into the side of spring arm 29 and deflect spring arm 29 from an untensioned position (FIGS. 4A and 4E) to a deflected or tensioned position (FIG. 4C). This would create a bias or return force on gate 22, which would also keep lead nut 26 on short threaded portion 54. As lead screw 50 continues to rotate and push the front most product, lead nut 26 (now fully engaged and following threaded portion 54), would push gate 22 to an open position via link arm 25. This would open door 22 automatically. In the relatively quick time it would take for door 22 to open, the foremost item would fall off tray 110 and leave the inventory row by gravity.

The VMC or other controller for the module can return gate 22 to closed by simple short reverse operation of the motor and lead screw 50. This would move lead nut 26 back and pull gate 22 closed. In one example, the vending machine 100 can have a sensor that informs the VMC 108 a product has been dispensed. See, e.g., U.S. Pat. No. 7,565,222 to inventor Popelka, incorporated by reference herein (an optical sensor which senses when a product has moved to delivery bin 106). The motor subassembly 30 would be controlled to turn lead screw 50 one way to dispense a product, which moves the push plate forward and opens gate 22 automatically. When the dispense sensor senses a product drop, the motor would stop and then reverse for a short time to pull gate 22 shut. Gate 22 would then resume blocking of the next item in the row.

As can be appreciated, the designer would select the components and threading, as well as the distances for desired cooperative action.

As will be appreciated by those skilled in the art, by appropriate control of the push plate, the holding force for a closed door 22 does not have to be substantial. But it can be enough to block with relatively practical force against inventory falling off a ledge, including an attempt to tilt a vending machine to cheat the system.

The front gate subassembly 20 has at least the following functions:

a. Gate 22 is in the closed or blocking position before a vend sequence is initiated. This allows an operator to tip the tray forward to fill the machine without the product falling from the machine. It also prevents product from falling if the machine is shaken.
b. During the vend sequence, the front support gate 22 opens and allows the product to drop or dispense, moving to a non-blocking position of the row of items.
c. When the front-most product is vended, gate 22 then closes and resumes blocking the row.
d. The front support gate 22 is reversible in the sense it, and its functions, can be easily switched between a closed position going to the right (as in FIGS. 4A and B), or to the left (as in the right-most module 10R in FIG. 8A). It can also be removed. Reversibility is achieved as follows. Spring 27 is configured to have mirror-image wings 28. Therefore in either closed position, a wing 28 cooperates with spring arm 29 to bias gate 22 closed when lead screw 50 is not operating, and provide biasing forces to tension gate 22 closed. The pivot points to which gate 22 is attached to body 18 of module 10 allows pivoting essentially 180 degrees. Link arm 25 simply has to disconnected (one pin or screw removed at 24), the gate 22 swung to an opposite closed position, and link arm 25 repinned to header 23 and the pinning hole on the opposite side of header 23. It can therefore be seen that this reversibility is quick and easy and does not require different or extra parts or complicated tools or steps.

3. Quick Mount Clamping System

As previously discussed, the whole module 10 can be quickly and easily mounted, removed, or repositioned on tray 30. It can essentially be clamped into place.

The front end 14 of module 10 has a hook 15 which can be hooked over front edge 113 of tray 110. The back end 16 of module 10 has a clamping mechanism.

FIGS. 5A to 5D illustrate the clamping features of the back end of module 10.

FIGS. 5 and B show how a clamp subassembly 60 can do so. A cam bracket 62 is attached at the back end of module 10. When the front of module 10 is hooked to the front of the tray, the cam bracket 62 is at the back lip 114 of tray 110. An eccentric cam 62 with a flat surface 65 can be rotated around axis 63 in bracket 62 by manual lever 64.

By comparing FIGS. 5A and B with FIGS. 5C and D, it can be seen that a clamping member 66 slides along the longitudinal axis of clamp guide or channel 68 in bracket 62. Clamping member 66 has a slot or hook 67 that is adapted to lock over a complimentary bent rear edge 114 of tray 110 (see FIG. 5D where the sliding clamp member is separated from tray edge 114)). When lever 64 is rotated down and towards tray 110 (unlocked as in FIGS. 5C and D), the distance between the rotational axis of cam 62 and back end of sliding clamping member 66 shorter, so clamp member 66 (and its hook receiver 67) allow release of module 10 from tray 110. But when lever 64 is rotated up, it bring flat 65 against the back end of sliding clamp member 66. Because the distance between the rotational axis of cam 62 and the back end of clamp member 66 becomes increased longer, this pushes clamp member 66 towards tray edge 114 (see FIGS. 5A and B), hooks 67 and 114 engage, and thus the whole module is locked to tray 110. The flat on cam 62 will hold cam 62 against rotation until lever 64 is manually operated to release it.

It can therefore be seen how this arrangement allows for quick and easy mounting, removal, or repositioning of module 10 relative to tray 110. When the front end of module 10 is hooked to the front of tray 110, this clamping subassembly 60 fixes module 10 in any position along the lateral width of tray 110.

As shown in FIGS. 5A, 5B, 5C, and 5D, this cam lock arrangement allows for quick and easy installation, adjustment, and release of any module 10. As can be appreciated, cam body 52 can be made of a variety of materials including metal or plastics.

This exemplary embodiment uses a specific horizontal tray or shelf inside a vending machine cabinet. However, as will be well-appreciated by those skilled in the art, it can be installed in a wide variety of current glass-front automated merchandising machines, or on a wide variety of other support structures, including those of the type that might be used with micro markets.

Each module 10 has infinitely variable side-to-side adjustability on the tray by using a pinch lever on the back of each module, and a hook or similar retainer on the front. This allows for quick configuration in the field or on-the-fly.

The tray can be mounted onto pull-out slides, or have a tray tip function for quick loading.

4. Push Plate and Lead Screw

FIGS. 6A to 6D illustrate features of push plate subassembly 40 and lead screw 50. As can be appreciated from the Figures, push plate subassembly 40 can include a main body or plate 42 and a carriage or lead nut 44. Lead nut 44 can wrap at least partially around lead screw 50 and have complementary threading or teeth that would follow the direction of rotation of threads 52 of lead screw 50. Plate 42 extends outwardly and laterally in a basically perpendicular manner from the wall of the main body of module 10. A lower boss or runner 49 can provide a bumper and slide surface for push plate 42 as it moves back and forth along the wall 18 of the module 10. The mass of plate 42, by gravity, would tend to rotate push plate 42 down and against the wall, as well as keep carriage 44 seated down on threaded lead screw 50.

As can be appreciated, push plate 42 would basically be held in position but could be removable for maintenance or replacement.

Lead screw 50 back end is essentially supported at its rear by its connection to motor 30. The front end of lead screw 15 is supported basically at a bearing 52 at the front.

As can be seen from FIGS. 6A-E, carriage is somewhat an inverted C-shape. One side of the C-shape (reference number 46) has mating threading for lead screw 50. So does the other near side (reference number 47). A bridging portion 45 between sides 46 and 47 goes over the top of lead screw 50. Plate 42 is rigidly connected o carriage 44 (reference number 48). When top shield 12 is removed, the whole push subassembly 40 can be dropped down on module 10.

FIGS. 6D and E show how a snap lever 73 can be manually lifted up on top of carriage 44 to release the whole push subassembly 40 from lead screw 50. It can be lifted up when shield 12 is removed (see FIG. 6E). When lever 73 is snapped down, it locks carriage 44 in place on lead screw 50.

The inverted C-shape carriage 44 is dropped vertically down onto lead screw 50, and the threads of both engaged. The push plate hangs from connection 48 along the side 18 of module 10. Bumper or runner 49 reduces friction as plate 42 moves along wall 18. Shield 12 can be replaced (and attached by just a few screws or otherwise). The mass of plate 42 urges carriage against the top approximately 270 degrees of circumference of lead screw 50. If needed, for maintained, replacement or reversed position, the opposite steps are conducted. Shield 12 is removed, the whole push subassembly is lifted up. The open bottom of the C-shaped carriage 44 comes free of lead screw 12 and plate 42 follows. The subassembly can then be either replaced. To reverse it on module 10, it is simply flipped and lowered back onto lead screw 50. The threading of carriage 44 is such that whether engaged in either lateral direction it will follow the rotation of lead screw as controlled by the motor.

FIG. 6C shows another feature of the embodiment. The asymmetrical shape of carriage 44 allows it to be tilted rearwardly along lead screw 50 while lever 73 urges it to remain there. This titling rearward sufficiently disengages the threads on carriage 44 from those on lead screw 50 so that the entire push subassembly 40 can be slid rearwardly on lead screw 50 to, for example, reset it to the back of module 10 to restock the row.

As is illustrated in the Figures, push plate 40 can include indicia 41. One example is "sold out". This would be a visual reminder to user or stocker that inventory needs to be replenished. This could be on one side or both sides, as plate 42 is reversible, as discussed above. Other indicia are possible.

Push plate 40 therefore accomplishes at least the following functions:

a. One selection to be able to push a minimum of 15 lbs. during a vend sequence.
b. Optionally comes with an extension built-in to cover more pushing distance if needed.
c. Additional parts can be added to assist in pushing smaller product.

As will be appreciated, alternative form factors for push member 40 are possible. Instead of a plate of basically rectangular form, one or more elongated fingers might be used. One example would be one finger intermediate the bottom and top edges of housing 18. Another would be two or more fingers extending laterally away from proximal side of housing 18 and generally parallel and spaced apart between bottom and top edges of housing 12. Another would be some type of frame having outer members but open interior spaces. Another would be a grid, screen, or combination of cross members (e.g. vertical and horizontal, or diagonal, or combinations). The surfaces of the push member that abut the row of product could vary. For example, it could range between: smooth and non-smooth, low friction and high-friction, textured or non-textured, the same or different materials, etc.

C. Operation

As can be appreciated from the foregoing, operation and use of module 10 can include the following.

One or more modules 10 would be installed by the clamping action described above at selected positions on a tray 110. Inventory would be loaded in a row, back to front, along each module 10 with push plate 40 moved all the way to a back position appropriate for that row of inventory.

Front gate/retainer 20 would be in a normally closed position.

Motor 30 would be operatively connected to an intelligent controller such as VMC 108. Upon consumer or user selection and authorization, VMC 108 would cause the following actions:

Motor 30 would turn lead screw 58 to move push plate 40 forward.

Lead nut 26 would be grabbed by the lead screw threads 54.

As lead screw 50 continues to rotate, lead nut 26 on threads 54 would push gate 22 all the way open.

As lead screw 50 continues to turn front most object would be free to drop by gravity.

When it has cleared gate 22 and lead screw 50 stops rotating, the next object in the row would be at the front of module 10.

Lead screw 50 would be reverse rotated to pull gate 22 closed and move carriage 24 back towards unthreaded section 53 of lead screw 50. The restoring force of spring arm 29 would help return gate 22 to closed position.

Dispenser 10 would wait for the next dispensing instruction.

Therefore, in this exemplary embodiment, operation of each module would proceed as follows:

a. The module is activated when VMC 108 starts the vend sequence to dispense a product. This action, and the way it accomplished, is well-known to those skilled in this technical art.

b. When the vend sequence is started, module 10 pushes whatever product is in the module forward, opening the front gate 22 until the forward-most product passes by the machine product detection sensors (see, e.g., U.S. Pat. No. 7,565,222, incorporated by reference herein).

c. When the product passes the sensors, the module 10 reverses allowing the front gate 22 to close and to be prepared to dispense the next product in line.

D. Options and Alternatives

It will be appreciated that the invention can take many forms and embodiments. Variations obvious to those skilled in the art will be included within the invention. Some alternatives and options have been mentioned above.

For example, scale and materials can vary according to desire and need. Additional options and alternatives are possible. A few examples follow.

1. Expandable Push Plate

FIGS. 7A and 7B show an optional feature. An extension 43 can be pocketed inside push plate 42 in a retracted position. See FIG. 6A. It can be pulled out to widen the reach of push plate 40. See FIGS. 7A and B.

One option would be to include a selectable extended position over a range of positions. One possible way to do this is shown at FIG. 7B. Bosses or nubs 70 could be on the exterior of extension 43. The inside pocket of push plate 42 could include edges 72 that abut the rows of nubs 70. Essentially in a ratchet-like manner, the edges would seat between adjacent nubs in each row and resist movement towards or away from module 10. They would essential be mechanical stops against such movement. However, the edges and/or nubs could have some resiliency or elasticity such that if sufficient manual force is exerted on extension 43 in either direction, edges 72 would deflect over nubs 70. The nubs and slots would provide adjustable fixation of the extension along a range.

2. Adjustments

Examples of adjustable clamping of a module for variable positioning on a tray or other support have been described. Other mounting systems are possible. The clamp could vary. The method of holding the front of module 10 to the tray can vary. This does not preclude the module from being fixed in place by such things as fasteners (e.g. screws, bolts, rivets, pins, adhesive, etc.). Other mounting methods could be by tension, key-in-slot, and interference fit.

Examples of adjusting the width of the push plate have been described. Others are possible, including interchanging different fixed width plates.

Examples of configuring each module have been discussed, as well as operating a module independently or in pairs.

3. Coordinated Set of Dispensers

Another optional feature is illustrated in FIGS. 8A and 8B. In this embodiment, both the motor assembly and the front retaining door assemblies can be removed by simply one or a few screws. As shown in these Figures, for larger or wider dispensable products, two modules 10 could be mirror imaged on a tray 110 by simply reversing the push plate subassembly 40 and the gate subassembly 20 (as described above) from one side of its module 10 to its other side. See the rightmost module 10R in FIGS. 8A and B as compared to the leftmost module 10L.

But both modules 10 would then work the same way even though they are now mirror imaged. Both gates 22 would open together as both push plates 42 move together.

As can be appreciated, using only a screw driver, a module 10 can be reversible thus allowing the user to create left and a right versions. Motors of the pair of modules can be paired together through vending controller software. Larger products can be dispensed in a single selection. This is a further optional benefit of this embodiment.

4. Dispensing Environments

As can be appreciated, the components of the modules can be selected to work in a variety of operating environments. For example, the components can be selected to work at refrigerated temperatures, including fresh food temperatures (e.g. above 32° F. but less than ambient) or freezing temperatures (e.g. below 32° F.). But also, the modules can be configured to work at higher end temperatures (e.g. (e.g. above normal room or ambient temperatures in workplaces). For example, towards and above 100° F. is possible such as might be experienced for modules placed outdoors or inside industrial areas (manufacturing production floors).

What is claimed is:

1. A module for serially dispensing items comprising:

a. an elongated member having first and second opposite ends, top and bottom edges, and proximal and distal sides along a longitudinal axis;

b. a mounting system at the bottom edge of the elongated member having to releasably fix the elongated member to a support;

c. a drive member mountable above the bottom edge along and between the first and second opposite ends of the elongated member;

d. a push member operatively connectable along the drive member and extending laterally from the proximal side of the elongated member;

e. an actuator mountable at one of the first and second opposite ends of the elongated member, operatively connectable to the drive member, and having an input which converts an electrical instruction into operation of the actuator to operate the drive member to move the push member in a controlled manner along the proximal side and between the first and second opposite ends of the elongated member;

f. so that the module can be mounted at adjustable positions on a support by the mounting system and selectively configured between a first state with the actuator operatively mounted at the first opposite end of the elongated member for mounting the module with the push member extending laterally in a first direction and a second state with the actuator operatively mounted at the second opposite end of the elongated member for mounting the module with the push member extending laterally in a second direction opposite the first direction.

2. The module of claim 1 wherein the elongated member comprises a housing having a height between the top and a bottom edges that is larger than a thickness between proximal and distal sides, and a length between the first and second opposite ends that is substantially larger than either the height or thickness.

3. The module of claim 2 wherein the distal and proximal sides of the elongated member are at least substantially rectangular in shape.

4. The module of claim 2 wherein the drive member comprises a lead screw at or near the top edge of the elongated member with a drive end adapted for removable connection to the actuator and a lead screw support at an opposite end.

5. The module of claim 4 wherein the push member comprises a lead nut with complementary threading to the lead screw such that rotation of the lead screw causes linear translation of the push member along the proximal side of the elongated member.

6. The module of claim 1 wherein the push member comprises a push plate having a height at least a substantial amount of the height of the elongated member.

7. The module of claim 1 wherein the push member is adjustably expandable to varying distances from the proximal side of the elongated member.

8. The module of claim 1 further comprising a gate assembly mounted at the other of the first and second opposite ends from which the actuator is mounted.

9. The module of claim 8 wherein the gate assembly comprise:

a. a gate member translatable between a blocking position extending laterally from the proximal side of the elongated member to a non-blocking position;

b. a mounting interface to the elongated member;

c. a bias member to assist in translating the gate between blocking and non-blocking positions.

10. The module of claim 9 wherein the gate comprises:

a. a gate door;

b. an extension from the gate door;

c. a spring arm in abutment with the extension;

d. a linkage between the gate and the lead screw which causes movement of the gate between blocking and non-blocking positions.

11. The module of claim 1 wherein the mounting system comprises:

a. a releasable clamp mountable at one of the first and second opposite ends for adjustable clamping the elongated member to a support, and b. a retention member on the other of the first and second opposite ends to retain the elongated member against movement in at least one direction.

12. The module of claim 11 in combination with a support comprising a tray having a floor between front and back edges and opposite side edges, wherein the front and back edges correspond with the clamp and retention member of the module, so that the module can be removeably and adjustably clamped between front and back edges of, and in any of a variety of positions between opposite side edges of, the tray.

13. The combination of claim 12 wherein the proximal side of the elongated member is generally vertical when the module is installed on the tray and the floor of the tray is generally horizontal floor to comprise a guide and support for a row of items to be dispensed, and the push plate extends laterally from the proximal side over an adjacent part of the floor.

14. The combination of claim 13 farther comprising a controller operatively connected to the actuator to rotate the lead screw to move the push plate along the elongated member.

15. The combination of claim 14 further comprising a human machine interface operatively connected to the controller to receive human input correlated to operating the actuator.

16. The combination of claim 14 further comprising a communications device operatively connected to the controller for communicating with other devices.

17. The combination of claim 16 wherein the other devices include at least one of:

a. the internet;

b. a remote computer;

c. another module.

18. The module of claim 1 in combination with another module mounted a spaced apart distance on the support but with the elongated member, push member, motor, and gate configured in a mirror image configuration, so that the push members of each module extend towards one another and both modules can cooperatively operate in synchronization to push a row of items positioned between them in the same direction.

19. The combination of claim 18 wherein the motor of each of the pair of modules is operatively connected to and operated in synchronization by a controller.

20. The module of claim 1 in combination with one or more additional said modules each mounting by the mounting system at spaced apart distances from one another on the support and each in operative communication with a controller for individual and selective dispensing.

21. The combination of claim 20 wherein the support comprises a tray, shelf, or frame installed in a cabinet, open display, or storage compartment.

22. The combination of claim 21 wherein the cabinet is a glass front, automatic merchandising machine having an internal space for a plurality of trays at different vertical heights and a drop zone along front edges of the trays.

23. A quick-release, laterally adjustably dispensing module for serial dispensing of items stored in a row on a support supporting bottoms of the items in the row comprising:

a. a longitudinal wall having first and second opposite ends;

b. a lead screw along the wall;

c. a push plate extending laterally from the wall and operatively connected to the lead screw to translate rotation of the lead screw into linear movement along the wall;

d. a quick-release, infinitely adjustable clamping system on the wall to mount the wall to a support;

e. a quick-release motor adapted to mount to the lead screw at either of the first and second opposite ends of the wall.

24. The module of claim 23 further comprising a gate at the other of the first and second opposite ends from the motor, the gate opening and closing in correspondence to dispensing an item.

25. The module of claim 23 wherein the support comprises a tray, a shelf, or a frame.

* * * * *